US007306548B2

(12) United States Patent
Martin et al.

(10) Patent No.: US 7,306,548 B2
(45) **Date of Patent: *Dec. 11, 2007**

(54) EXERCISE APPARATUS FOR SEATED USER, AND RELATED METHODS

(75) Inventors: J. True Martin, Tallahassee, FL (US); Wallace Kent Martin, Tallahassee, FL (US)

(73) Assignee: J. True Martin Irrevocable Trust, Tallahassee, FL (US)

( * ) Notice: Subject to any disclaimer, the term of this patent is extended or adjusted under 35 U.S.C. 154(b) by 44 days.

This patent is subject to a terminal disclaimer.

(21) Appl. No.: 11/365,996

(22) Filed: Mar. 2, 2006

(65) Prior Publication Data

US 2006/0276311 A1 Dec. 7, 2006

Related U.S. Application Data

(63) Continuation-in-part of application No. 11/142,367, filed on Jun. 2, 2005.

(51) Int. Cl.
*A63B 21/00* (2006.01)

(52) U.S. Cl. ..... 482/92; 482/51; 297/5

(58) Field of Classification Search ..... 482/92, 482/51; 297/DIG. 4, 5; 280/250.1, 304, 280/647; 211/23; 135/67
See application file for complete search history.

(56) References Cited

U.S. PATENT DOCUMENTS 195,116 A 9/1877 Foster
2,661,817 A 12/1953 Mullins
2,720,396 A 10/1955 Pfaus
4,153,244 A 5/1979 Tauber
4,199,137 A 4/1980 Giguere
4,600,188 A 7/1986 Bangerter et al.
4,747,595 A 5/1988 Mabry et al.
4,765,614 A 8/1988 Shute
5,833,575 A 11/1998 Holslag
5,839,995 A * 11/1998 Chen ..... 482/92
5,851,166 A 12/1998 Bernardson
6,716,143 B1 4/2004 Martin

OTHER PUBLICATIONS

Don Kreb's Access to Recreation brochure, Fall 2005 ed., pp. 1, 2, 14-19, 22-29, 36-40.

* cited by examiner

*Primary Examiner*—Lori Amerson
(74) *Attorney, Agent, or Firm*—Berenato, White & Stavish

(57) ABSTRACT

An exercise apparatus and method are provided for permitting a seated user to perform a variety of upper and lower body exercises without the need to leave a seated position. According to one embodiment, the exercise apparatus includes a support base, and first and second foot assemblies each configured to receive a respective foot of a seated user of the apparatus, and a pulley assembly. The pulley assembly has a pulley line and a hand-graspable component that is manipulable by the seated user for performing upper body exercise movements, while at least one of the foot assemblies provides resistance for the upper body exercise movements.

24 Claims, 18 Drawing Sheets

EXERCISE APPARATUS FOR SEATED USER, AND RELATED METHODS

CROSS-REFERENCE TO RELATED APPLICATION

This application is a continuation-in-part of U.S. patent application Ser. No. 11/142,367 filed in the U.S. Patent & Trademark Office on Jun. 2, 2005, the complete disclosure of which is incorporated herein by reference.

FIELD OF THE INVENTION

The present invention relates to an apparatus and method for permitting a user to perform a variety of lower extremity and upper body exercises while remaining in a seated position.

BACKGROUND OF THE INVENTION

During the last few decades, a wide array of exercise equipment has been made commercially available for home use. The vast majority of this equipment is targeted or designed for healthy people that want to work out to improve or maintain their current health or increase muscle mass. The plethora of infomercials and marketing reflects the saturation of this market. The majority of target users for this equipment range from teenagers to healthy sixty year-olds.

The productive use of almost all of this exercise equipment assumes minimal or no physical disability (e.g., paralysis of the arms and/or legs, clumsiness, loss of coordination, etc.). This is a healthy population.

With improvements in healthcare, the average life expectancy is now approximately eighty years old. However, during the course, and especially in the latter years of their now increased lifespan, many of these people experience disease, injury, permanent impairments or disabilities (e.g., strokes; trauma from a motor vehicle accident or fall; work injuries; or degenerative disease of the brain, spinal cord or peripheral nerves) that significantly restrict their physical capabilities. These physical afflictions have several important ramifications. First, these physical impairments or handicaps prevent effective use of the vast majority of exercise equipment. Additionally, people in this population have increasing difficulty with transportation to and from health clubs, gyms and physical therapy facilities. This increasing population is currently underserved by existing exercise equipment.

Another portion of the population that has difficulties in using standard exercise equipment and transporting to and from health clubs are people who use or depend on wheelchairs. A sudden lower body injury from a sporting event or an accident, a debilitating disease or medical condition, and recovery from surgery are just some of the reasons that people use and come to rely upon wheelchairs. Some people, such as those who break one or both legs in a skiing accident, for example, are in wheelchairs for a relatively short period of time while their bodies heal. Others, such as those that receive a spinal cord injury, spend substantially longer time in the wheelchair or may even spend the rest of their lives being wheelchair bound.

One important aspect of life that wheelchair occupants quickly learn to appreciate is that despite the fact that a large portion of the day is spent in the wheelchair in a sitting position, their bodies need to exercise on a regular basis to stay in shape, just like everyone else. Even paraplegics, who lack feeling in their legs, need to tone leg and upper body muscles.

Toward this end, several devices have been proposed that allow a person to remain in a wheelchair or other seated position while performing exercises of all types to allow the person to stay in shape. Some such devices, which work with varying degrees of efficiency, tend to be unduly complex in design and relatively expensive to manufacture and thus unaffordable. Other such devices tend to be unduly difficult to set up and use, making the user frustrated and possibly causing the individual to abandon exercising altogether. Still other devices, although relatively simple in design and construction and relatively easy to assemble and use, are limited in that the devices exercise only a small portion of the user's body. The user is required to purchase several different devices and move from device to device in order to achieve a full body workout. While some users may not object to such an arrangement, others will find it a difficult solution due to the purchase costs of several pieces of equipment, and the large storage needs of the several pieces. Furthermore, if the person needs help manipulating the equipment and moving on and off of the exercise devices another person is required to be present during the entire workout.

Therefore, it is an object of the invention to fulfill a need in the art for an apparatus that allows a wheelchair occupant, an ambulatory but impaired person or an unimpaired person to achieve a robust full body workout and which addresses the above stated problems found in the art. It is another object of the invention to provide an apparatus that permits such person to perform both aerobic and anaerobic exercises. Still another object of the invention is to provide an exercise apparatus for such persons that is relatively simple in design and construction, can be manufactured inexpensively using standard manufacturing techniques, and is relatively easy to assemble, install and use. The exercise apparatus of the invention preferably provides the user with a large variety of exercises, and still more preferably exercises for both the lower body and the upper body, and both aerobic and anaerobic, to allow the user to exercise all desired muscle groups without the need for a large number of devices. Such an apparatus preferably allows the user to switch between exercises without the need for an additional person to be present so as to allow the user the ability to go through an exercise routine unassisted. Ideally, such an apparatus is comfortable and natural for the person to use.

SUMMARY OF THE INVENTION

To achieve one or more of the foregoing objects, and in accordance with the purposes of the invention as embodied and broadly described herein, according to a first aspect of this invention there is provided an exercise apparatus featuring a support base, foot assemblies each configured to receive a respective foot of a seated user of the exercise apparatus, and a pulley assembly. The foot assemblies each have a respective proximal end portion and a respective distal end portion, and are mounted on the support base to permit selective performance and switching between a pivoting exercise and a translational sliding exercise. The pivoting exercise involves the seated user performing hip extension and flexion movements to motion the foot assemblies pivotally, whereas the translational sliding exercise involves the seated user performing foreleg extension and flexion movements by motioning the foot assemblies longitudinally back and forth. The pulley assembly comprises a pulley line operatively connected to at least one of the foot assemblies, and a hand-graspable component manipulable by the seated user for performing upper body exercise movements and causing the connected foot assembly to provide resistance to the upper body exercise movements.

A second aspect of the invention provides an exercise apparatus featuring a support base, pedals, and a pulley assembly. The pedals each are configured to receive a respective foot of a seated user of the exercise apparatus for permitting the seated user to perform a lower extremity exercise. The pulley assembly has a pulley line operatively connected to at least one of the pedals, and a hand-graspable component manipulable by the seated user for performing upper body exercise movements and causing the connected pedal to provide resistance to the upper body exercise movements.

Other aspects of the invention reside in methods of exercising with and assembling the exercise apparatus.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

Figure 1:
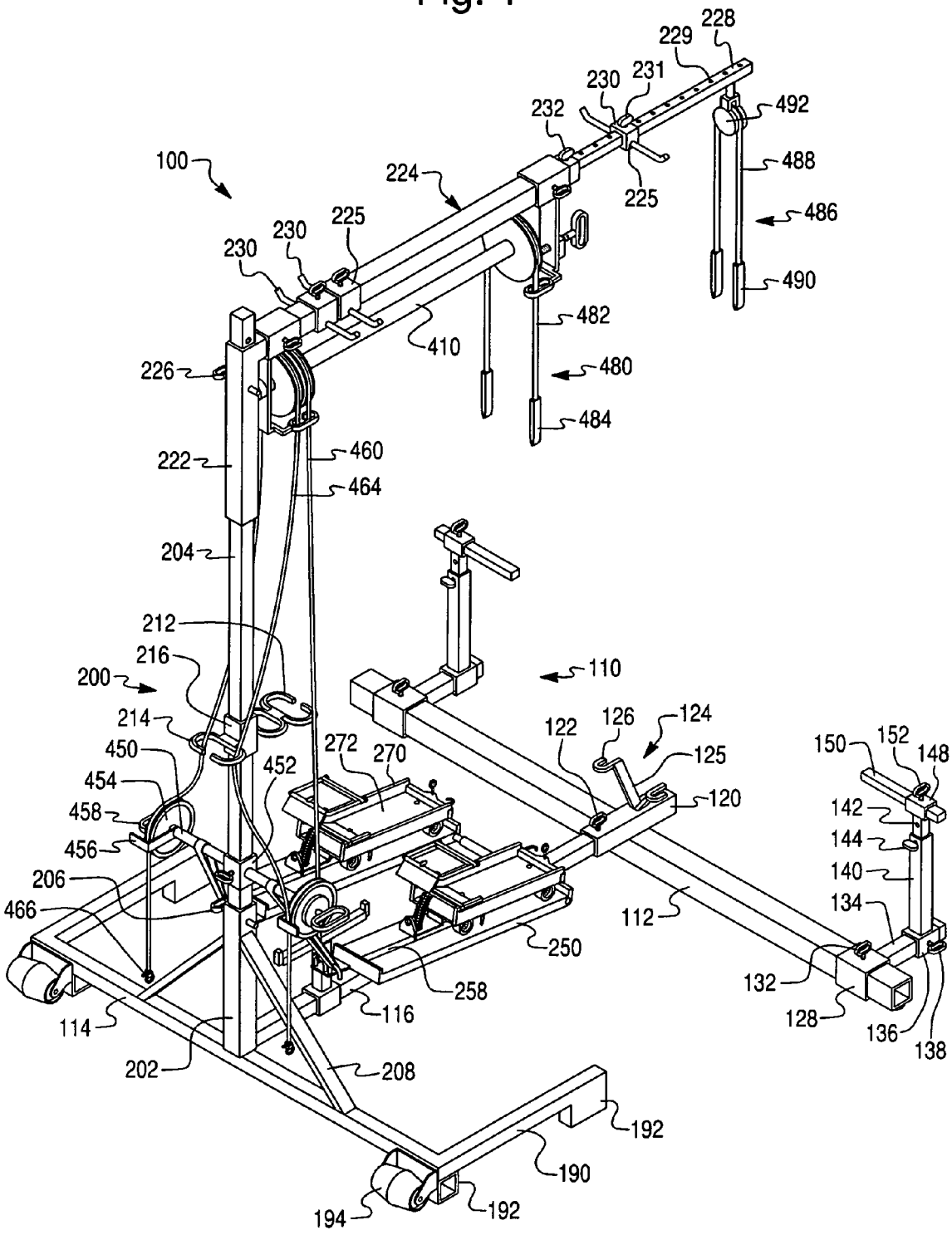
FIG. 1 is a perspective view of an embodiment of an exercise apparatus of the present invention.

DETAILED DESCRIPTION OF CERTAIN PREFERRED EMBODIMENTS AND METHODS OF THE INVENTION

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

The exercise apparatus embodied herein is particularly useful for persons having varying degrees of physical disabilities. A prime example of this would be persons using or reliant upon wheelchairs. One advantage of the embodied exercise apparatus is that such wheelchair-bound persons need not leave their wheelchairs to operate the apparatus. Depending upon the functionality of the user, most if not all of the exercises can be performed without requiring assistance from another person. Additionally, the apparatus includes both active and passive exercises with adjustable resistance/tension for many of the exercises.

Use of the exercise apparatus is not limited to paraplegics and other wheelchair-bound persons, however. For example, the exercise apparatus is useful for rehabilitation purposes, such as those persons suffering lower extremity injuries but not restricted to a wheelchair. The exercise apparatus is also useful for other individuals, such as the elderly or those requiring or desiring lower body muscle toning or cardiovascular workouts. It should be understood that healthy persons having minimal or no physical disabilities may also benefit from use of the apparatus.

Additionally, the compactness of the exercise apparatus makes it suitable for home use, although the apparatus may be employed in multi-user environments, such as health clubs, gyms, physical therapy facilities, hospitals, rehabilitation centers, extended healthcare facilities, and the like.

Figure 2:
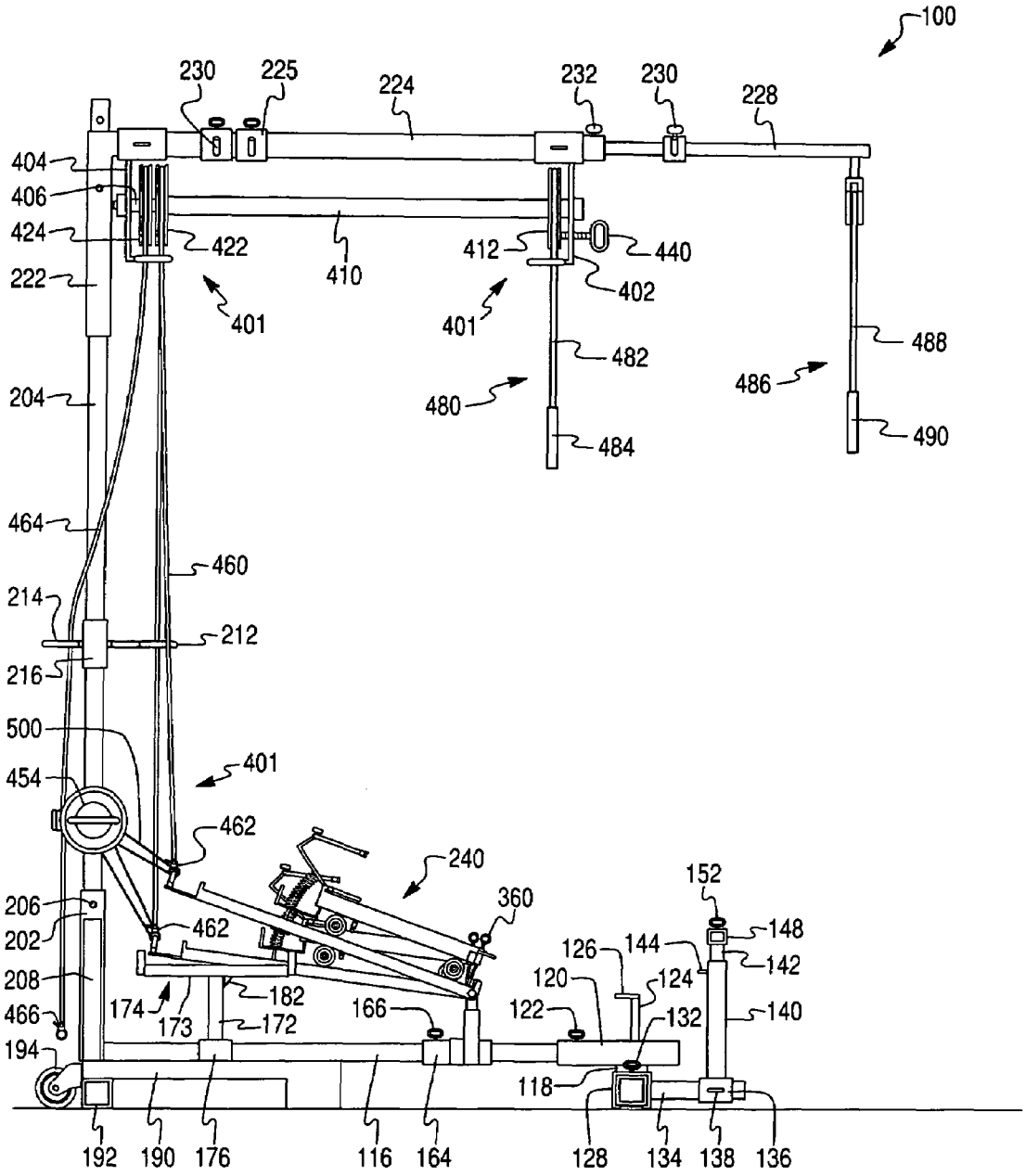
FIG. 2 is a side view of the embodied exercise apparatus of FIG. 1.

Referring now more particularly to the perspective and side views depicted in FIGS. 1 and 2, respectively, an exercise apparatus according to an embodiment of the invention is generally represented by reference numeral 100. The embodied exercise apparatus 100 includes a support frame structure 110. The bottom of support frame structure 110 includes a lateral proximal frame member 112, a lateral distal frame member 114, and a longitudinal frame member 116. As used herein, the terms proximal and distal refer to location of a component of exercise apparatus 100 relative to the intended operating position of the seated user, such as a wheel-chair occupant. As also used herein, the term "forward" means a direction going from proximal to distal, whereas the term "rearward" means the opposite direction, i.e., from distal to proximal.

A stem 118 protrudes from the lateral midpoint of the upper surface of proximal frame member 112. Stem 118 is integrally connected to an adjustable collar 120, which is journaled for sliding movement of longitudinal frame member 116 therethrough. A threaded bore exposed at the upper surface of collar 120 retains a screw fastener 122. Turning screw fastener 122 in opposite directions moves the lower terminus of screw fastener 122 respectively into and out of abutting engagement against an upper surface of longitudinal frame member 116. In abutting engagement, the lower terminus of screw fastener 122 frictionally retains collar 120 (and integrally connected proximal frame member 112) in locked position relative to longitudinal frame member 116. When fastener 122 is turned out of abutting engagement, collar 120 and integrally connected proximal frame member 112 are slidable forward and rearward relative to longitudinal frame member 116 to permit adjustment to the spacing between proximal frame member 112 and distal frame member 114. Upon attaining spacing between frame members 112 and 114 that best accommodates the anatomy of the particular user, screw fastener 122 is tightened into locked position.

It should be understood for the purposes of this disclosure that any suitable connection techniques and means may be used for establishing the connections of the various components (discussed above and below) of the embodied exercise apparatus 100. For example, permanent (or integral) connections, such as, for example, the connection between stem 118 and either of proximal lateral frame member 112 or collar 120, may be accomplished using welds, mechanical fasteners (e.g., bolts, screws, rivets), bonding agents, adhesives, adhesive tape, etc. Non-permanent or adjustable connections, such as, for example, between collar 120 and longitudinal frame member 116, may be accomplished using quick-release pins, graspable screw fasteners, spring-loaded pins, locking pins, the like, and other suitable mechanisms and means. As should be understood to a person skilled in the art, many of the connections described herein as non-permanent may be made permanent, and vice versa. In the interest of brevity, the description set forth below focuses on connectors and techniques depicted in the drawings. It should be understood that additional or alternative connectors and techniques not illustrated or described herein may be employed for joining components together in a fixed or adjustable relationship.

Returning to the frame member 112, collar 120 has a V-shaped bracket 124 with angled arms 125 that extend upwardly from the upper surface periphery of collar 120. Located at the upper end of each arm 125 of V-shaped bracket 124 is a respective hook 126. Hooks 126 are used for securing resistance element 502 (FIG. 7), as discussed in greater detail below.

Frame collar adapters 128 are located along opposite ends of proximal lateral frame member 112. A screw fastener 132 received in the through hole at upper periphery of each frame collar adapter 128 has a lower terminus that is moveable into and out of abutting engagement against the upper surface of proximal lateral frame member 112. When screw fastener 132 is loosened, frame collar adapter 128 is slidable laterally along the length of proximal frame member 112. Outward lateral movement of frame collar adapters 128 is limited by a stopper (not shown), such as, for example, a foot protruding from the bottom of member 112, for preventing of frame collar adapters 128 from sliding off the ends of proximal lateral frame member 112. Tightening of screw fastener 132 abuts the lower terminus thereof against proximal lateral frame member 112, creating sufficient frictional force to inhibit lateral sliding movement of frame collar adapter 128 along the frame member 112.

Proximal legs 134 are integrally connected to frame collar adapters 128 at one end and protrude rearwardly therefrom. Post collar adapters 136 are carried by and are slidably adjustable along legs 134. Legs 134 include a screw fastener 138, which operates in a manner similar to screw fasteners 122 and 132 described above to permit or restrict sliding movement of collar adapters 136 along the length of legs 134. Upright frame posts 140 are connected integrally to post collar adapters 134, and include post extenders 142 telescopically received therein. Pin fasteners 144 permit locking of post extenders 142 in upright frame posts 140 for positioning stabilizers 150 at a desired vertical height. Stabilizer collar adapters 148 integrally connected at the top of each post extender 142 receive lateral stabilizers 150. Stabilizers 150 are slidably adjustable within adapters 148 and into engagement with opposite sides of a wheelchair for stabilization in use. Preferably, stabilizers 150 are received in adapters provided on the wheelchair for holding leg/foot supports, which are removed from the wheelchair when exercising. Screw fasteners 152 retained in holes extending through stabilizer collar adapters 148 function similarly to screw fasteners 122 and 132 described above to permit or restrict lateral sliding movement of lateral stabilizers 150.

The distal end of longitudinal frame member 116 connects to the central region of distal frame member 114. In the illustrated embodiment, distal frame member 114 and longitudinal frame member 116 are integrally joined to one another. Distal legs 190 are positioned at opposite ends of distal frame member 114. Distal legs 190 extend rearward towards proximal lateral frame member 112. Distal lateral frame member 114 and distal legs 190 are supported on feet 192, which contact ground when exercise apparatus 100 is in rested (non-transported) position. A pair of transport rollers 194 is attached to the distal face of distal frame member 114. Transportation of exercise apparatus 100 is accomplished by tilting apparatus 100 into a position in which transport rollers 194 contact the ground to support exercise apparatus 100. Pushing or pulling tilted apparatus 100 supported on rollers 194 permits rolling movement of apparatus 100 as rollers 194 contact and rotate over ground surface, thereby facilitating transportation without requiring the entirety of apparatus 100 to be lifted.

Figure 5:
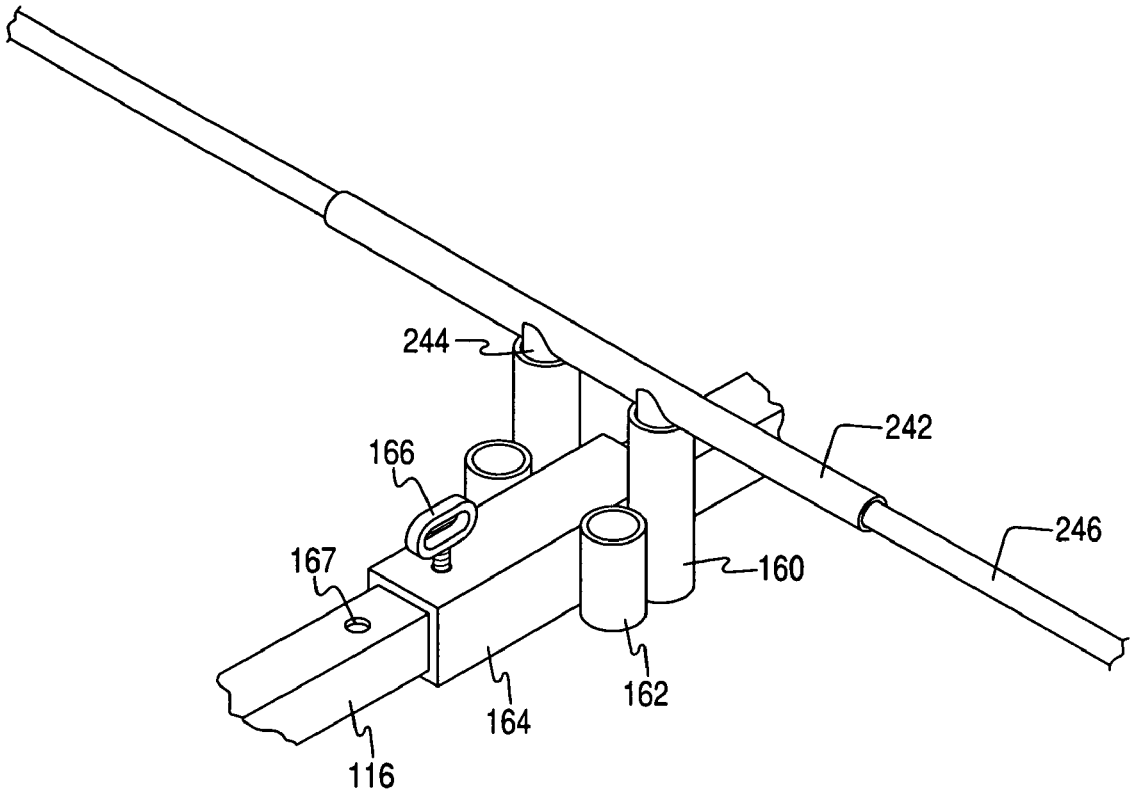
FIG. 5 is an enlarged perspective view of a portion of a frame assembly of the exercise apparatus of FIG. 1.

Turning to FIGS. 2 and 5, longitudinal frame member 116 is equipped with central collar adapter 164 for adjusting the position of foot assemblies 240, discussed below. Screw fastener 166 is retained in a selected one of a series of through holes 167 of central collar adapter 164. Sets of prong seats 160, 162 are integrally formed on central collar adapter 164. In the illustrated embodiment, prong seats 160 and 162 are configured as cylinder tubes having vertical axes. Prong seats 160 are positioned on opposite sides of longitudinal frame member 116 symmetrical to one another. Likewise, prong seats 162 are positioned on opposite sides of longitudinal frame member 116 from one another. Prong seats 162 are below and forward of prong seats 160. The provision of multiple seats 160, 162 at different heights provides for arranging foot assemblies 240 at multiple inclines, selectable by the user.

Post 172 is integrally connected to slidable collar adapter 176, which is shown in FIG. 2 forward of central collar adapter 164. An adjustable T-bar 174 features a stem member slidably received in post 172 and an integrally connected pedal-engaging cross member 173. The T-bar stem member of T-bar 174 is raisable to permit rotation of T-bar 174 for placement of T-bar cross member 173 into either parallel relationship (FIGS. 1, 2, 6, and 8) or transverse relationship (FIG. 7) with respect to longitudinal frame member 116. T-bar 174 is then lowered to telescopically receive T-bar stem member in post 172. In the parallel relationship depicted in FIGS. 1, 2, 6, and 8, T-bar cross member 173 is between foot assemblies 240 so as not to interfere with pivotal movement of pedals 250. In the transverse relationship depicted in FIG. 7, pedals 250 rest on T-bar cross member 173. An appendage 182 extending from the lower surface of the T-bar cross member is spaced from T-bar stem member to provide a gap capable of receiving a cross section of post 172. When the T-bar cross member is lowered to rest against the top of post 172, the snug fit of post 172 cross section between appendage 182 and the stem portion obstructs rotation of T-bar 174, thereby locking the lowered T-bar cross member in either parallel or perpendicular relationship to longitudinal frame member 116.

Frame structure 110 further includes a stanchion 200 extending upward from the central area of distal lateral frame member 114. To improve storability of exercise apparatus 100, stanchion 200 can be provided with a bottom mount base 202 and a separable mast 204 having a lower end portion slidably received in mount base 202. A locking pin 206 passes through respective aligned holes of mount base 202 and mast 204 for securing mast 204 in place. Angled support brackets 208 extend from opposite ends of distal frame member 114 to opposite sides of mount 202 to provide additional support and stability to stanchion 200. A notched proximal cable-stowing ring 212 and a notched distal cable-stowing ring 214 are provided on opposite sides of stowing-ring collar adapter 216 on mast 204 for cable storage. A screw fastener (not shown) of stowing-ring collar adapter 216 operates similarly to fasteners 122 and 132 for selectively permitting vertical movement and locking of collar adapter 216 at a desired height along mast 204.

Slidably journaled to the top portion of mast 204 is a mounting sleeve 222 and an integrally connected, overhead cantilever boom 224. A locking pin 226 (FIG. 1) extends through an aperture of mounting sleeve 222 and a selected aligned aperture of a series of vertically spaced apertures in mast 204 to retain mounting sleeve 222 (and cantilever boom 224) at a preselected desired height. Height selection of cantilever boom 224 may be based on, for example, the upward reach limit of the user from a seated position.

Boom 224 includes a plurality of laterally extending storage hooks 230 with integrally connected collar adapters 225 slidable on boom 224. Screw fasteners 231 are provided to fix collar adapters 225 at a desired location. The proximal end of boom 224 receives a slidable boom extender 228 that can be extended telescopically from boom 224. Boom 224 has a vertical aperture alignable with any one of a plurality of spaced vertical apertures 229 of boom extender 228. Boom extender 228 is slidable forward and rearward to a desirable position. Once the desired position is achieved, locking pin 232 is inserted through a top aperture of boom 244 and one of the aligned apertures 229 of boom extender 228 for securing boom extender 228 in place.

The foot assemblies of the present invention will now be described in detail with reference to FIGS. 1-5. In the interest of brevity and simplification, and because the left and right foot assemblies are substantial mirror images of one another, the following description will primarily focus on a single assembly. For the purpose of this description, the terms "left" and "right" are made in reference to a view from the position of a seated user of exercise apparatus 100, e.g., left foot assembly is engaged by the user's left foot, and the right foot assembly by the user's right foot. As shown in the drawings, the left and right foot assemblies 240 are adjacent and substantially parallel to one another.

As best shown in FIG. 5, a base support 242 has prongs 244 that extend into and are secured in one of the sets of prong seats 160 or 162. In FIG. 5, prongs 244 are received in prong seats 160. Prongs 244 are movable between prong seats 160 and 162 by lifting base support 242 upward out of engagement with seat 160 or 162, shifting prongs 244 longitudinally relative to seats 160, 162, and lowering base support 242 downward to bring prongs 244 into securing engagement with respective seats 160 or 162. Selection of prong seat 160 or 162 for receipt of prongs 244 can be made based on the anatomy and needs of the user, including the incline at which the user desires foot assembly 240. Shaft 246 is journaled for rotation within base support 242 and its ends extends laterally outward beyond the ends of the support 242 for providing a pivot axis mount for pedals 250.

Figure 3:
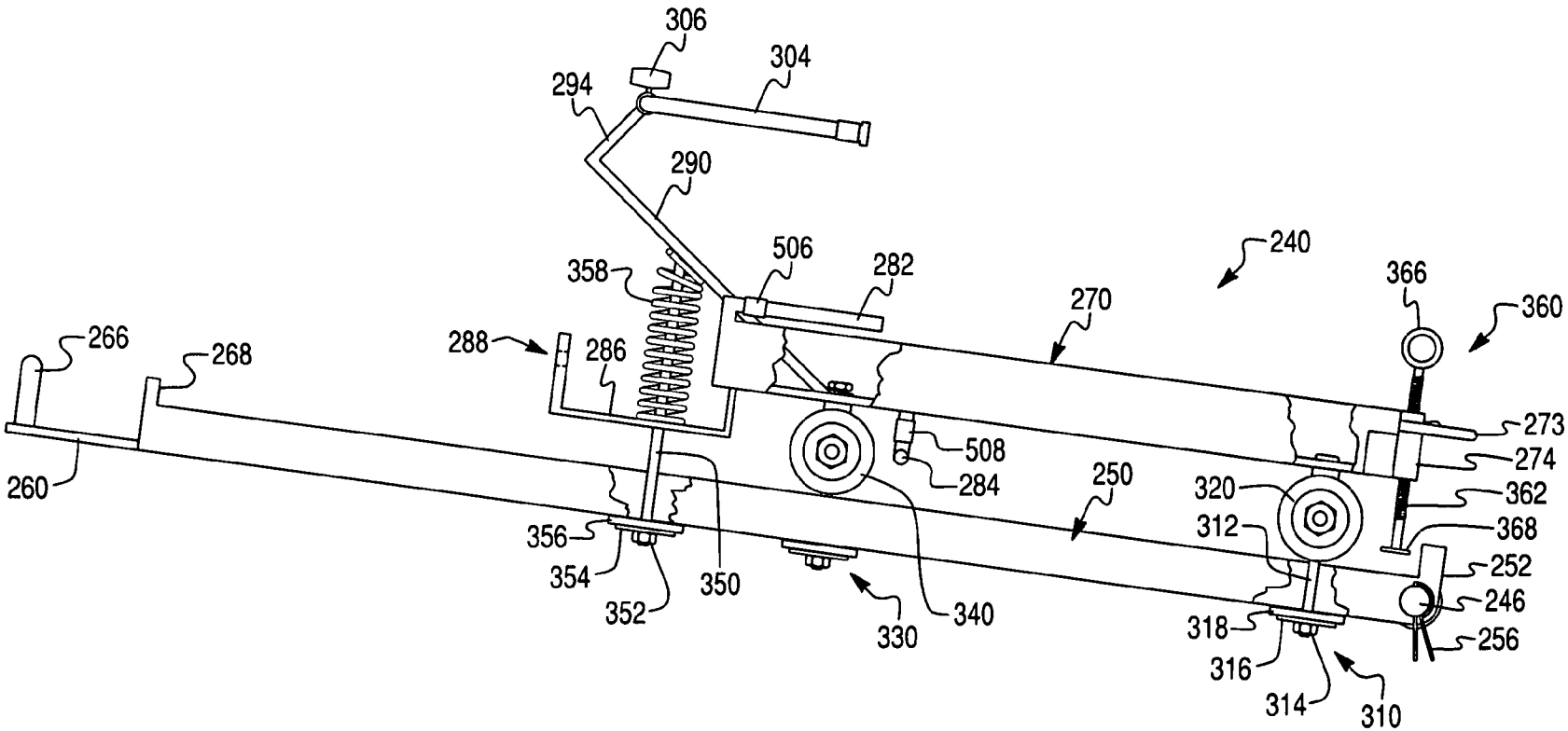
FIG. 3 is a side, partially cut-away view of a foot assembly of the exercise apparatus of FIG. 1.
Figure 4:
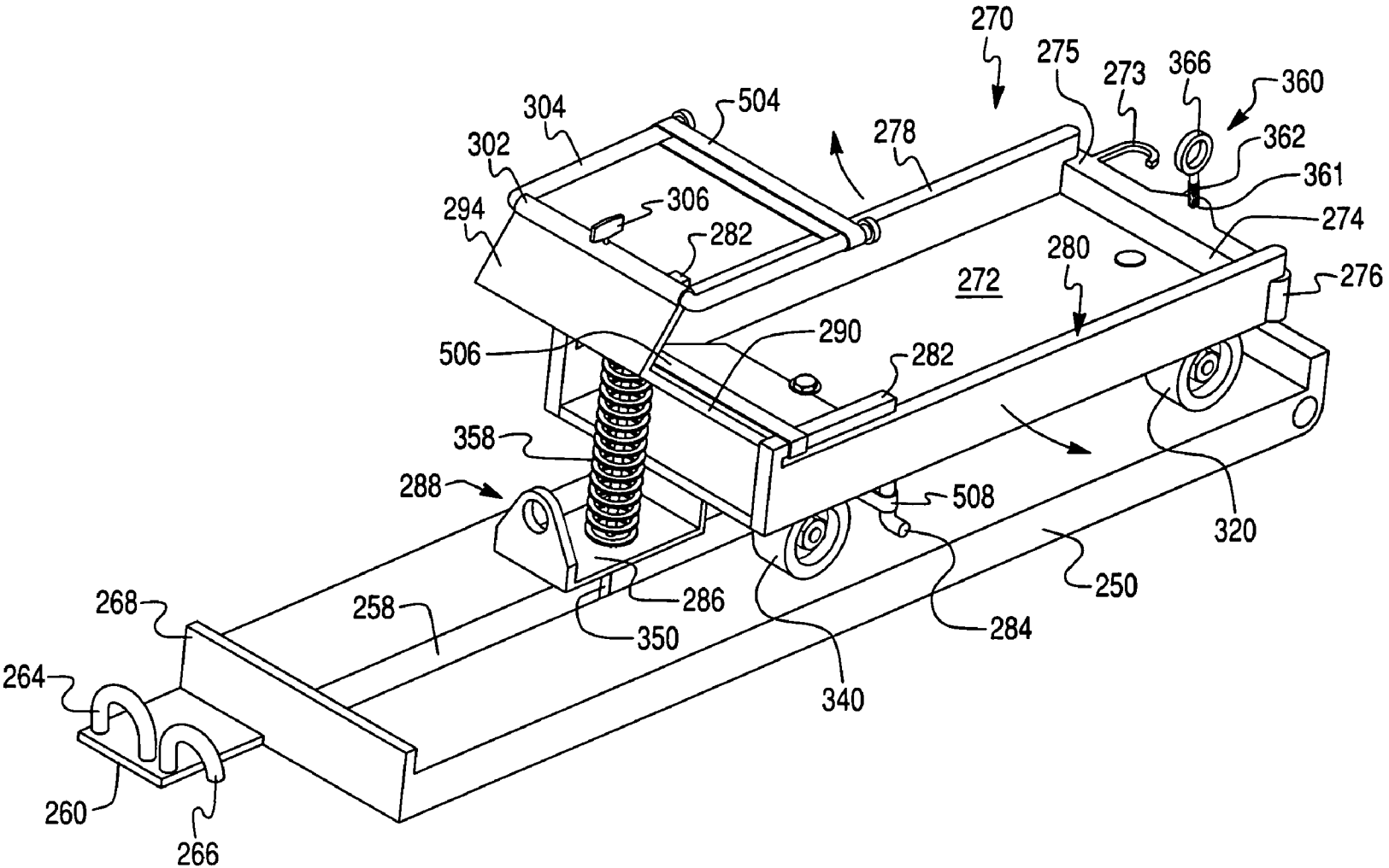
FIG. 4 is a perspective view of the foot assembly of FIG. 3.

As shown in FIGS. 3 and 4, pedal 250 has a proximal end with an upwardly stopper bracket 252. The proximal end of pedal 250 is provided with a bore to receive pivot shaft 246 to permit pivotal movement of pedal 250 about pivot shaft 246. A locking pin 256 is positioned through an aperture at the end of pivot shaft 246 for preventing bracket 252 from sliding laterally out of engagement with pivot shaft 246.

Pedal 250 has a central runner (or guide) channel 258 extending longitudinally, between proximal and distal ends of pedal 250. The distal end of pedal 250 has a stopper 268, which together with stopper bracket 252 limit the sliding range of shoe 270. Extending forward from the distal end of pedal 250 is an extension plate 260. A cable-receiving eyelet 264 and hook 266 are adjacent to one another and extend upwardly from the distal end of extension plate 260.

Foot assembly 240 further features a slidable shoe 270. Bottom foot plate 272 of shoe 270 is sized and accessible to receive the bottom of a foot of the user. Heel buttress 274 is attached to the proximal end of shoe 270. Hook 273 is connected to and extends outwardly away from heel buttress 274. Hook 273 cooperates with hook 126 to retain resistance element 502 (FIG. 7) in an operative position. Bottom plate 272 and heel buttress 274 are generally transverse to one another. Opposite ends 275 of heel buttress 274 include pivot joints 276 which pivotally connect an inner side foot panel 278 and an outer side foot panel 280 to heel buttress 274 for permitting side foot panels 278 and 280 to independently pivot away from one another about joints 276. Side foot panels 278 and 280 respectively include opposed upper arms 282 and opposed lower arms 284. Upper arms 282 are located above foot plate 272 for retaining resistance element 506, whereas lower arms 284 are located below foot plate 272 for retaining resistance element 508. Resistance elements 506 and 508 apply a biasing force to urge side foot panels 278 and 280 towards one another inwardly. Lower arms 284 of side foot panels 278, 280 abut against opposite sides of foot plate 272 to limit their inward range of motion. L-shaped bracket 286 extends forward of and below the distal end of foot plate 272. Bracket 286 includes eyelet 288 facing forward for coupling with clasps 466 of cable 464.

Angled toe pad 290 positioned between and generally forward of side foot panels 278 and 280 includes a distal end with an integral forward toe stop 294 arranged substantially transverse to toe pad 290. Spurs (not shown) projecting from the bottom of angled toe pad 290 extend through apertures of foot plate 272 for retention and alignment purposes. As shown in FIGS. 3 and 4, the proximal end of angled toe pad 290 optionally abuts against runner bolt head and associated washer of distal runner assembly 330, described below, to prevent rearward movement of toe pad 290 relative to foot plate 272.

A sleeve 302 is mounted on one end of toe stop 294. An articulated double-arm bracket 304 has a spindle (not shown) passing through sleeve 302 in order to adjustably connect it thereto. Bracket 304 supports resistance element 504. A screw fastener 306 retained in sleeve 302 has a terminus moveable into abutting engagement with the spindle. The spindle is preferably provided with a polygonal (e.g., hexagonal) cross section against which the terminus of screw fastener 306 may be abutted against for locking bracket 304 at a desired pivotal location.

Foot assembly 240 is also provided with a proximal runner assembly 310 and a distal runner assembly 330 for securing shoe 270 to pedal 250 while permitting sliding movement of shoe 270 along pedal 250. As best shown in FIG. 3, proximal runner assembly 310 includes a proximal runner bolt 312 extending through runner channel 258, so that the head of runner bolt 312 rests against the upper surface of foot plate 272. A locking nut 314 and washer 316 positioned below the bottom surface of pedal 250 engage screw threads of runner bolt 312 for locking bolt 312 into engagement with runner channel 258. Friction reduction pad 318 is provided between washer 316 and the bottom surface of pedal 250 for facilitating sliding motion of shoe 270. A wheel mount carrying a pair of proximal wheels 320 operatively connected to runner bolt 312. Optionally, a spacer (not shown) can be disposed between wheel mount and the bottom surface of foot plate 272.

Distal runner assembly 330 is substantially similar in structure and function to proximal runner assembly 310 and, in the interest of brevity, is not described in as great of detail. Distal runner assembly 330 includes a distal runner bolt (not shown) extending through runner channel 258 and foot plate 272 so that the head of the runner bolt and a washer sit on the upper surface of foot plate 272 and against the end of toe pad 290 to retain toe pad 290 from rearward slippage. A wheel mount carrying a pair of distal wheels 340 is mounted to the runner bolt. Wheels 320 and 340 rest on the upper surface of pedal 250 to support shoes 270 thereabove and facilitate sliding motion of shoes 270 back and forth lengthwise along pedal 250. It should be understood that runner assemblies 310 and 330 may be modified or replaced by alternative constructions, e.g., rollers, glide mechanisms, etc., capable of sliding shoes 270 along pedal 250. It also should be understood that shoes 270 and pedals 250 may be combined into an integrated structure.

Another runner bolt 350 is mounted to the bottom surface of angled toe pad 290. Runner bolt 350 extends through bracket 286 and runner channel 258. Nut 352 and washer 354 secure runner bolt 350 in channel 258 and hold friction reduction pad 356 between washer 354 and the lower surface of pedal 250. Biasing member (e.g., spring) 358 seated on bracket 286 and captured by runner bolt 350 urges angled toe pad 290 upward, yet is compressible to permit downward movement of toe pad 290 when an adequate force is applied to overcome the biasing force.

At proximal end of shoe 270 is a brake 360 with a tensioning bolt 362 fitted through a threaded bore 361 of heel buttress 274. The upper end of bolt 362 has a handle 366. A friction pad 368 is mounted on the lower end of bolt 362. Handle 366 is rotatable to either move pad 368 downward into contact with upper surface of pedal 250 or raise pad 368 into spaced relation with the upper surface of pedal 250. When bolt 362 is moved downward a sufficient distance, frictional forces between pad 368 and pedal 250 immobilize shoe 270 from sliding motion along runner channel 258. When brake 360 is disengaged (i.e., raised), the friction forces provided by brake 360 are lessened or eliminated. Forward motion of shoe 270 along pedal 250 is limited by contact between runner bolt 350 and stopper bracket 268, whereas rearward motion of shoe 270 along pedal 250 is limited by contact between brake 360 and stopper bracket 252.

The pulley assembly 401 of apparatus 100 will now be described in detail with reference to FIGS. 1 and 2. Mounting brackets 402 and 404 suspend the pulley assembly 401 from boom 224. The pulley assembly 401 includes stationary elongated shaft 406 that extends through mounting brackets 402 and 404. Shaft 406 is housed in axle sleeve 410 lowered between brackets 402 and 404, with rotational bearings positioned between shaft 406 and axle sleeve 410 for permitting rotational motion of sleeve 410. Nuts or other fasteners at opposite ends of shaft 406 fasten shaft 406 to mounting brackets 402 and 404.

A proximal pulley 412 is integral with proximal end of axle sleeve 410 to rotate in unison with axle sleeve 410. The opposite end of axle sleeve 410 has a circular flange (not shown) mechanically fastened to distal pulleys 422, 424, which are adjacent one another and mounted on shaft 406 with suitable rotational bearings. In this manner, pulleys 412, 422, and 424 are locked together to rotate in unison with one another.

A key 440 comprising a threaded stem extends through a complementary threaded aperture of mounting bracket 402. Turning key 440 in opposite directions moves the end of key 440 either forward into an abutting relationship with proximal pulley 412 or rearward into a spaced relationship with proximal pulley 412. In this manner, key 440 permits the user to lock proximal pulley 412 and interconnected distal pulleys 422 and 424 in place, preventing rotational motion thereof. It is to be understood that key 440 may be replaced with other temporary locking mechanisms, such as, for example, a sliding bolt for engaging circumferentially spaced, off-center apertures of proximal pulley 412.

The pulley assembly 401 further includes shaft sleeves 450 coaxial with one another and mounted on opposite sides of collar adapter 452, which is received on and slidable upwardly and downwardly relative to stanchion 200. Rotational shafts (not shown) housed in shaft sleeves 450 carry respective pulleys 454. Mounted on each shaft sleeve 450 is an L-shaped stay 456 for retaining cable 464 in the grooves of pulleys 454. End clamps 458 retain pulleys 454 and stays 456 on the rotational shafts and shaft sleeves 450, respectively.

A cable 460 is operatively connected to and received in grooved slot of distal pulley 422. Clasps 462 are provided at opposite ends of cable 460. For exercise movements involving cable 460, clasps 462 of cable 460 are attached to eyelets 264 of extension plates 260. For exercise movements not requiring cable 460, clasps 462 are taken out of engagement with eyelets 264, and cable 460 is passed through the notch of proximal cable-stowing ring 212 on mast 204 for storage.

A cable 464 is operatively connected to and received in grooved slot of distal pulley 424 and the grooved slots of pulleys 454. Stays 456 retain cable 464 in the grooved slots of pulleys 454. Clasps 466 are provided at opposite ends of cable 464. For exercise movements utilizing cable 464, clasps 466 of cable 464 are attached to eyelets 288 of brackets 286. For exercises that do not involve cable 464, clasps 466 of cable 464 are disengaged from eyelets 288, and cable 464 is passed through the opening of distal cable stowing ring 214 on mast 204 for storage. Although pulley assemblies comprising cables are shown in the drawings, it should be understood that alternative systems are employable, such as V-belt pulleys for increasing frictional resistance and stability.

Grip 480 is provided with a grip strap 482 that is operatively connected to and received in groove of proximal pulley 412. Handles 484 provided at opposite ends of grip strap 482 are suspended within reach of a seated user. Another grip 486 is provided with a grip strap 488 having handles 490 at its opposite ends. Grip strap 488 is fed through pulley 492 and is sufficiently long to permit a seated user to reach and grasp handles 490 with opposite hands. When not in use, grips 480 and 486 are stowable on storage hooks 230 so as to not interfere with the seated user performing exercises. Examples of alternatives for handles 484 and 490 include straps, grips, bindings, Velcro, and the like. Grip straps 482 and 488 may be replaced with, for example, ropes, cables, wire, flat belts, etc., and combinations thereof.

Resistance elements are shown at several locations on exercise apparatus 100. The location and functions of these resistant elements will be discussed in greater detail below. In the illustrated embodiments, the resistance elements take the form of a band of elastic material, such as rubber. Resistance elements are represented in the figures by reference numerals 500, 502, 504, 506, and 508. It should be understood, however, that exercise apparatus 100 may use or be modified to implement additional or alternative resistance elements, such as, for example, springs, shock absorbers, pistons, weights, rubber tubing, air or hydraulic cylinders, etc., and combinations thereof.

Resistance/tension is adjustable independently for each exercise by application of different number of resistance elements or use of resistance elements having different resistivities. Also, resistance/tension is independently adjustable between the right and left foot assemblies, such that greater or lesser resistance may be applied to the right foot assembly then the left foot assembly, and vice versa. This flexibility in resistance application is especially desirable for persons having only one injured leg or disproportionate injuries to their left and right legs.

Positioning and retention of a wheelchair in exercise apparatus 100 will now be described. Exercise apparatus 100 is adjustable to accommodate various sizes and shapes of users. As described above, spacing between proximal and distal frame members 112 and 114 is accomplished by sliding collar 120 forward and rearward relative to longitudinal frame member 116 and tightening screw fastener 122. Collar 164 and fastener 166 permit positional adjustment to foot assemblies 240, while the incline (or pitch) of pedals 250 is adjustably selected by selective placement of prongs 244 in either seat 160 or 162. Other adjustments for adapting exercise apparatus 100 for a particular individual are evident from the description above.

Figure 6:
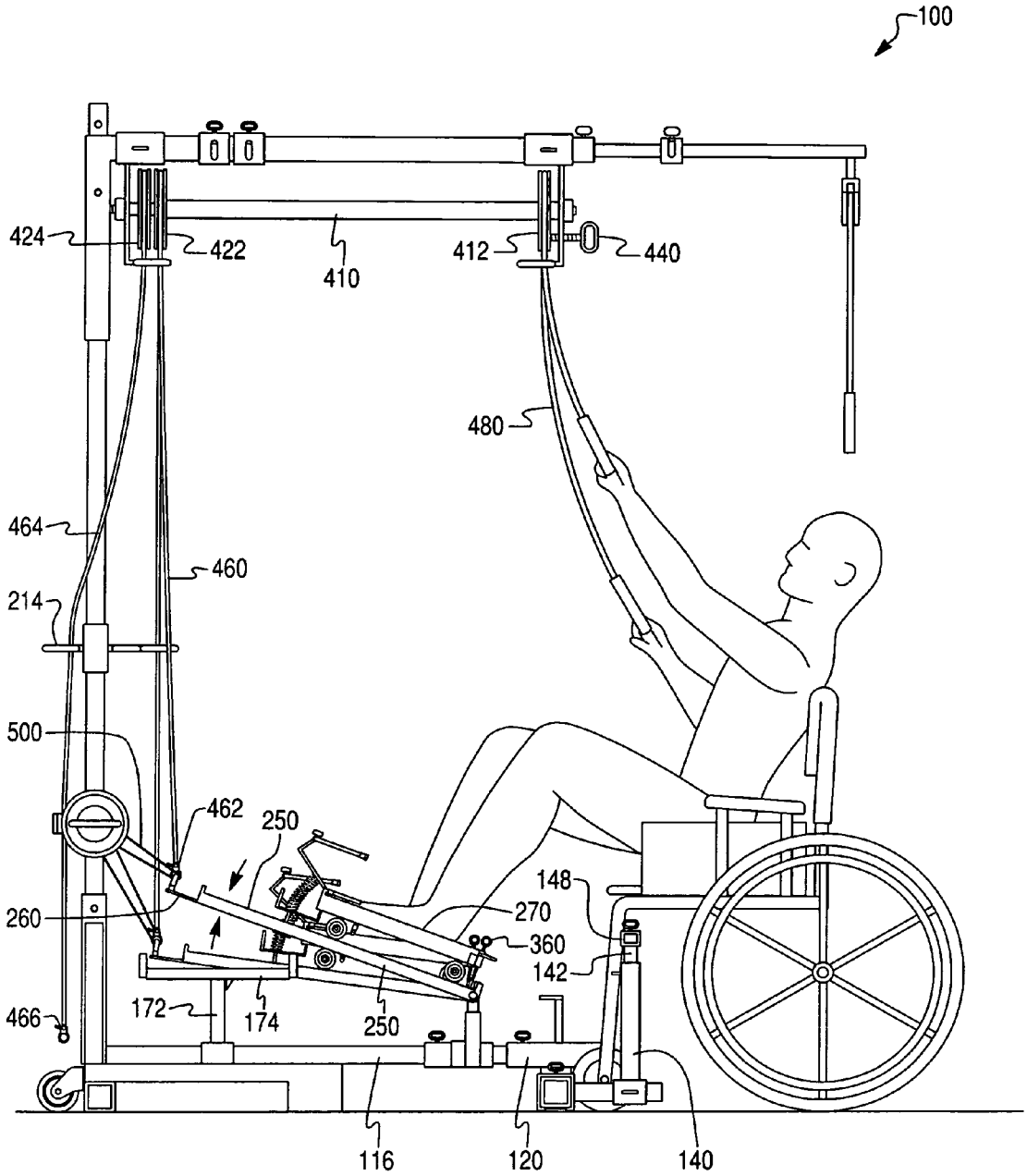
FIG. 6 is a side view of the exercise apparatus of FIG. 1, depicting a user performing an exercise comprising pedal pivoting movements on the exercise apparatus of FIG. 1.

As shown in the embodiment depicted in FIG. 6, a wheelchair is rolled forward into position. The front wheels of the wheelchair are preferably positioned rearward of proximal frame member 112. Positioning of proximal frame member 112 is accomplished by loosening fastener 122 and sliding collar 120 to a desired position on longitudinal frame member 116, followed by tightening of fastener 122. Frame collar adapters 128 are slid outward on proximal frame member 112 to create sufficient spacing to accept the width of the wheelchair. By loosening fasteners 138 and 152 and properly adjusting frame posts 140 and frame post extenders 142, the inward facing ends of lateral stabilizers 150 are aligned with the wheelchair. The lateral stabilizers 150 are contacted with the wheelchair, such as behind the front wheel supporting legs of the wheelchair or, more preferably, within foot-support adapter of wheelchair from which the foot supports have been removed for the purpose of performing exercises. Stabilizers 150 are locked in place (via fastener 152) to secure wheelchair against sideway, upward, or rearward movement during exercising.

Figure 11:
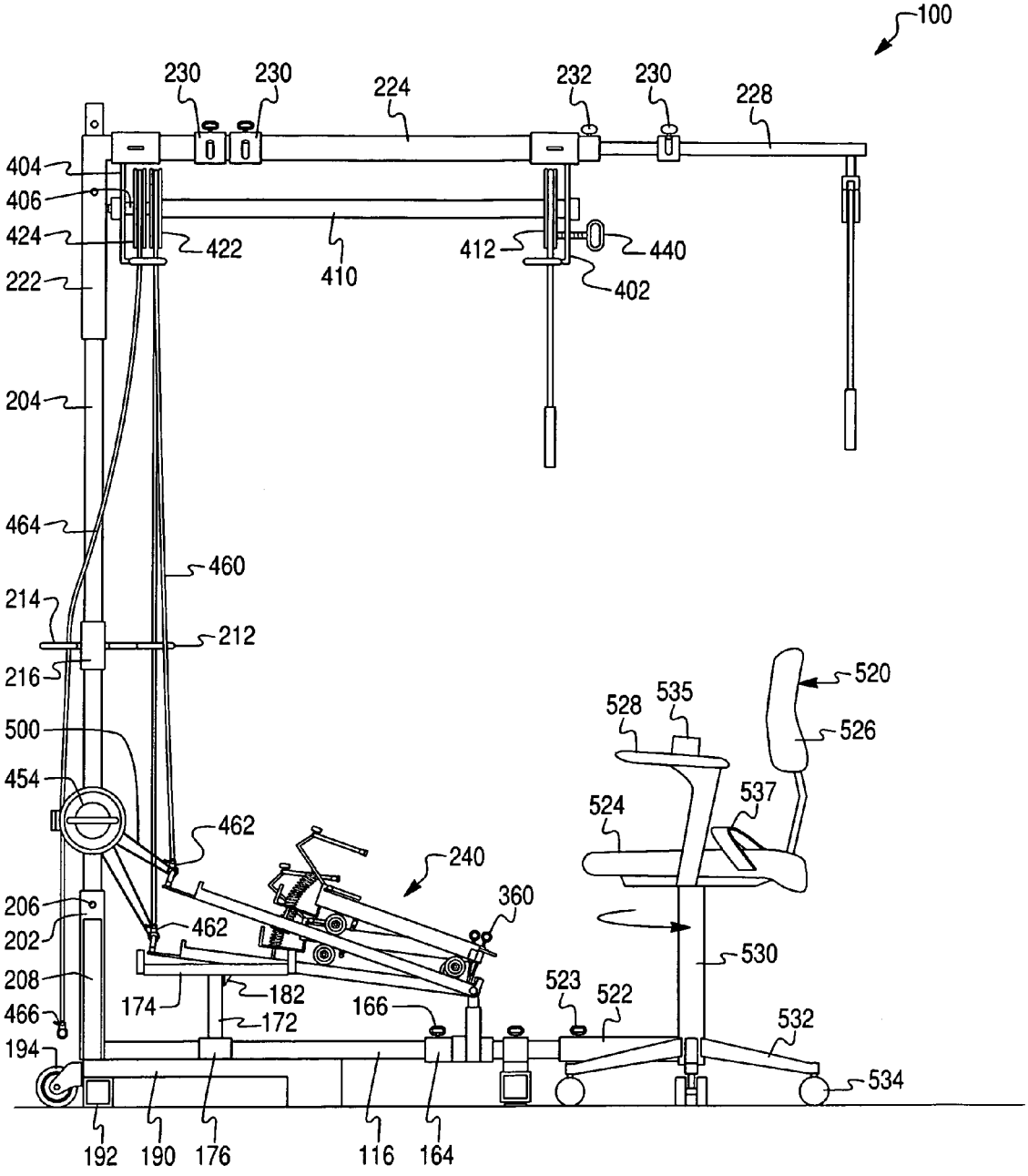
FIG. 11 is a side view of the exercise apparatus of FIG. 1 modified to incorporate a swiveling chair.

It also should be understood that chairs and seats other than wheelchairs may be used in conjunction with exercise apparatus 100, so long as the user is placed in a seated position permitting performance of the intended exercise(s). For example, as shown in FIG. 11, exercise apparatus 100 may be modified to include a chair 520. Chair 520 can be either permanently attached or selectively removable from apparatus 100. For the purposes of FIG. 11, an ergonomic office chair has been selected, although it should be understood that the illustrated office chair is only an example of chairs and seating devices that may be incorporated into exercise apparatus 100.

Chair 520 includes a seat 524, an adjustable back 526 connected to seat 524, arms 528 connected to opposite sides of seat 524, a column 530 carrying seat 524, a plurality of legs 532 connected to and symmetrically spaced about column 530, and a rotational caster 534 at the end of each leg 532. It should be understood that chair 520 may contain various adjustment features, including a height-adjustable cylinder for column 530, a seat slider and tilting mechanism for seat 524, a height adjustor for back 526, a head rest, etc. Preferably, seat 524 is capable of rotating about column 530 at least 90 degrees in each direction from the forward position depicted in FIG. 11 for facilitating the user's ingress into and egress from seat 524. Chair 520 may be modified to limit swivel movement of seat 524 and optionally lock seat 524 in a forward position during exercise. In order to provide additional safety, the chair may optionally be provided with a lap belt and/or shoulder belt. The use of either such belt assists in stabilizing the user in the chair, providing further protection against an inadvertent loss of balance or fall.

Exercise apparatus 100 may optionally include further features making use of the device safer. For example, exercise apparatus 100 may be modified to include a device for monitoring the heart rate and/or blood pressure of a user. Such devices are well known in the art and can be attached to users' arms for example. Such a device could be incorporated into chair 520 of exercise apparatus 100 illustrated in FIG. 11 or into a stand-alone or detachable device for utilization by a person in a wheelchair in the embodiment of the invention illustrated in FIG. 1. The heart rate and/or blood pressure monitoring device can also include a signaling system that sounds off an audible alarm and/or sends a wireless signal to an alarm or a third party to alert the user and/or a third party that the user is beyond preset limits for either heart rate and/or blood pressure. The wireless signal could include a message to relatives, caregivers, medical personnel or emergency service personnel for example.

Chair 520 is equipped with an adapter member 522 capable of receiving and mating with longitudinal frame member 116. Adapter member 522 is provided with a screw fastener 523 for securing the mating relationship between adapter member 522 and frame member 116, while permitting the detachment and removal of adapter member 522 when chair 520 is not needed or desired. Adapter member 522 may be integrally or detachably fastened to chair 520, for example, at the bottom of column 530. In order to provide adequate space for the attachment of adapter member 522 to column 530, chair 520 preferably yet optionally contains four legs 532 and associated casters 534.

Figure 12:
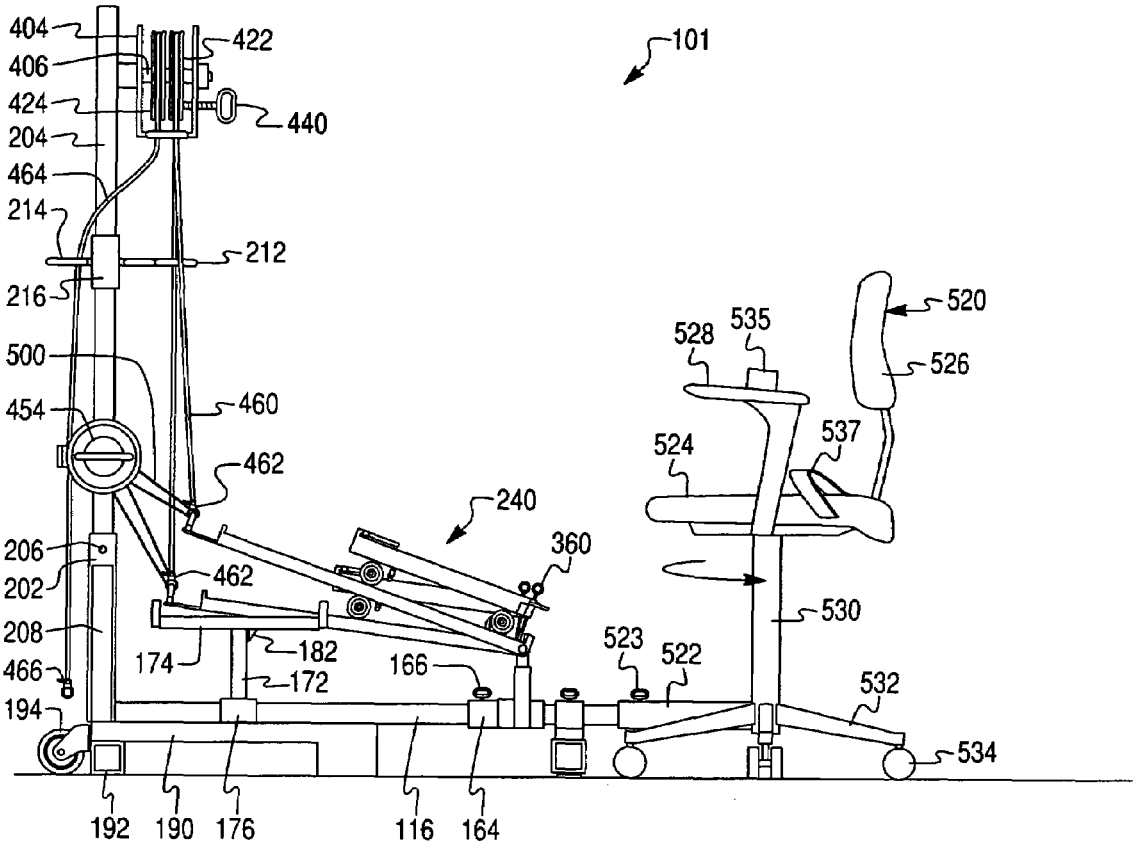
FIG. 12 is a side view of an alternative embodiment of the exercise apparatus illustrated in FIG. 11.

As illustrated in FIG. 12, the embodiment of device 101 can be further simplified if it is to be used in a non-rehabilitative standard exercise setting. In such an alternative embodiment, pulleys 422 and 424 can be moved downwardly and be attached to and supported by mast 204. Boom 224 and its associated shaft 406 and pulleys 412 and 492 can be eliminated. Foot assemblies 240 can also be simplified so as to permit only sliding and elliptical movements with all structures enabling additional exercise omitted.

Various exercises and exercise movements will be discussed in detail below.

Pedal Pivoting Exercise

Seated user positions a wheelchair or other sitting device in relation to exercise apparatus 100 as described above. As shown in FIG. 6, in preparation of pedal pivoting exercise, clasps 462 of cable 460 are engaged with eyelets 264 of extension plates 260. For this exercise, clasps 466 of cable 464 are disengaged from eyelets 288 and cable 464 is stowed in notched distal cable-stowing ring 214. Key 440 is loosened to permit free rotational movement of proximal pulley 412 and interconnected distal pulleys 422 and 424. Brakes 360 are actuated to forcibly contact brake pads 368 against the top surfaces of pedals 250, thereby locking shoes 270 in place by preventing sliding movement of shoes 270 along runner channels 258. Preferably, brakes 360 retain shoes 270 in longitudinal side-by-side alignment with one another. Adjustable T-bar 174 is arranged into parallel relationship with longitudinal frame member 116 so that T-bar 174 does not interfere with the up and down pivotal movements of pedals 250.

In operation, seated user places his or her feet on respective foot plates 272. Preferably, the user's feet are positioned against distal face of heel buttresses 274. The seated user performs hip extensor and hip flexor movements to reciprocally raise and lower pedals 250 pivotally about pivot shaft 246. Preferably, movement is accomplished without separating the user's feet from contact with the respective foot plates 272. Pivotal movement of pedals 250 simultaneously causes the opposite ends of cable 460 to move up and down and rotate distal pulley 422 back and forth. The amount of resistance and hence difficulty of the exercise for the user is increased using resistance elements 500. One end of resistance element 500 is placed around shaft sleeve 450 and the other end of resistance element 500 is engaged with hook 266. Multiple resistance elements 500 may be used for elevating resistance.

The hip extensor movement performed in this exercise is especially useful in working and strengthening the gluteus maximus muscles of user, whereas the hip flexor movement strengthens the iliopsoas. This exercise is particularly beneficial for persons having weakness and/or difficulty in climbing steps, rising from a seated position, and performing hip/leg extensions.

According to a modified version of the pedal pivoting exercise, grip 480 is operatively connected to pedals 250 and is manipulable by back-and-forth upper body motion of the seated user for assisting pedal movement. More specifically, grip 480 is operatively connected proximal pulley 412, which in turn is interconnected to distal pulley 422 via shaft sleeve 410 so that pulleys 412 and 422 rotate in unison. The seated user employs his or her upper body to move the ends of grip 480 back and forth, thereby causing proximal and distal pulleys 412 and 422 to rotate back and forth. Due to the operative connection between distal pulley 422 and cable 460, the rotational motion of distal pulley 422 causes the opposite ends of cable 460 to move up and down reciprocally, thereby pivotally raising and lowering of distal ends of pedals 250 connected to cable 460. Grip 480 is especially useful for paraplegics and for seated users lacking the lower extremity strength or agility to pivot pedals 250 without upper body assistance. The user may employ grip 480 as an assistance implement until such time as the user builds sufficient strength and/or coordination in his or her legs to operate the pedals 250 independently of upper body assistance. Alternatively, grip 480 may be used to provide an upper torso and extremity workout.

Shoe Translational Sliding Exercise

Figure 7:
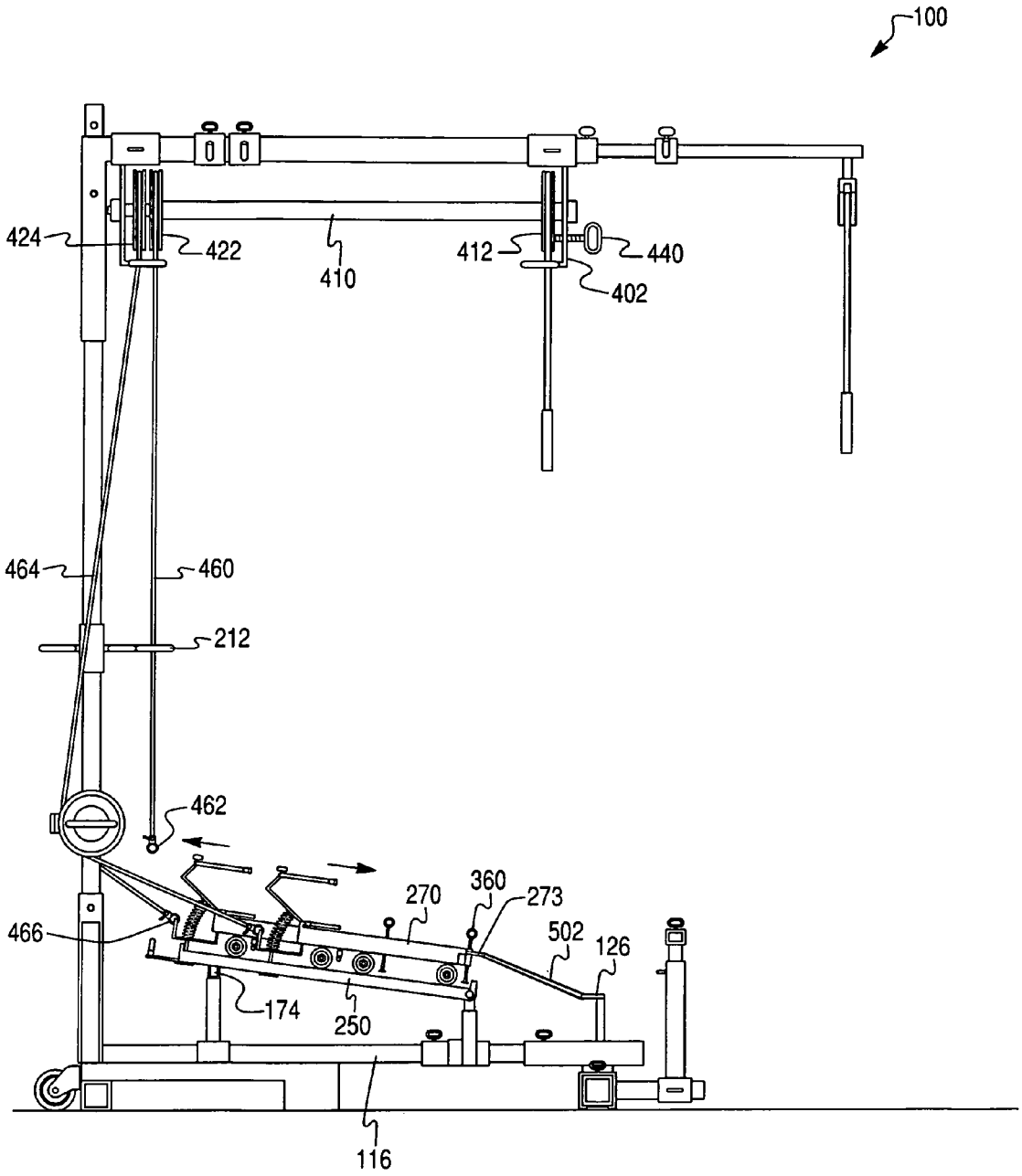
FIG. 7 is a side view of the exercise apparatus of FIG. 1, arranged to permit translational shoe sliding movements.

As shown in FIG. 7, in preparation of the translational shoe sliding movements, cable 464 is fed around pulleys 454, and clasps 466 at the opposite ends of cable 464 are engaged with eyelets 288. Clasps 462 of cable 460 are disengaged from eyelets 264 of extension plates 260 and cable 460 is stowed in proximal cable-stowing ring 212. Key 440 is loosened to permit free rotational movement of proximal pulley 412 and interconnected distal pulleys 422 and 424. Brakes 360 are deactivated by spacing pads 368 from the top surface of shoes 270, thereby permitting translational sliding movement of shoes 270 along runner channels 258 free of brakes 360. Adjustable T-bar 174 is arranged in perpendicular relationship with longitudinal frame member 116. The bottom surfaces of right and left pedals 250 are each positioned to rest on top of T-bar 174, such that T-bar operates as a locking mechanism to retain pedals 250 at a selected inclination. Preferably, right and left pedals 250 are parallel to one another and inclined at identical angles to establish side-by-side ramps of equal pitch.

The user is seated in a wheelchair or other sitting means as described above, and places his or her feet on respective foot plates 272. Preferably, the user's feet are positioned against distal face of heel buttresses 274, as described above with respect to the pivoting exercise. Employing foreleg extension and foreleg flexion movements, the user slides shoes 270 back and forth along stationary pedals 250 as translational movement is guided by runner channels 258. Preferably, movement is accomplished without separating the user's feet from the respective foot plates 272. Connection of cable 464 to eyelets 288 of shoes 270 establishes reciprocating movement of shoes 270, i.e., so that the left shoe moves rearward as the right shoe moves forward, and vice versa. Resistance may be controlled by attaching one or more resistance elements 502 to hooks 126 and 273, so that resistance is increased as shoes 270 are moved forward.

The foreleg extension movement performed during the translational sliding exercise is especially usefull in working the quadriceps muscles of user, including the vastus lateralis, vastus medialis, vastus intermedius, and rectus femoris. The foreleg flexion movement performed during the translational sliding exercise is especially useful in working the hamstrings, including the semi-membranosus and semitendinosus. The exercise is particularly beneficial for persons having overall leg weakness.

Several alternative set-ups are possible for performance of translational shoe sliding movement. For example, if the user is incapable of switching between cables 460 and 464, cable 460 may be retained engaged to eyelets 264 of extension plates 260 as described above for performing the pedal pivoting exercise. Pedals 250 are immobilized by tightening key 440 (rather than rotating T-bar 174 into its transverse position), preferably when the right and left pedals 250 are at equal pitches. Tightening key 440 prevents rotational movement of pulleys 412 and 422, which in turn immobilizes cable 460 to prohibit up and down pivotal movement of pedals 250. Shoes 270 are then slidable back and forth along pedals 250, guided along runner channels 258. Because shoes 270 are not interconnected to one another via cable 464 in this alternative embodiment, left and right shoes 270 are independently slidable in unison (side-by-side) or oppositely of one another. Disproportionate amounts of resistance may be applied to the left and right shoes. Resistance may be controlled, for example, based on the number of resistance elements 502 extending between hooks 126 and 273.

In a modified version of this exercise, grip 480 operatively connected to shoes 270 is manipulable by back-and-forth upper body motion of the seated user for assisting sliding shoe movement. More particularly, movement of grip 480 rotates operatively connected distal pulley 424, which is integrally connected to pulley 412 via shaft sleeve 410. As proximal and distal pulleys 412 and 424 are rotated back and forth due to upper body motion of the seated user, the opposite ends of cable 464 reciprocate back and forth, thereby effecting reciprocating sliding movement of shoes 270 connected to the opposite ends of cable 464. Grip 480 is especially useful for paraplegics and for seated users lacking the lower extremity strength or agility to slide shoes 270. The user may employ grip 480 until such time as the user builds sufficient strength and/or agility in his or her legs to slide shoes 270 without the assistance of grip 480. Alternatively, grip 480 may be used to provide an upper torso and extremity workout.

Elliptical Exercise

Figure 8:
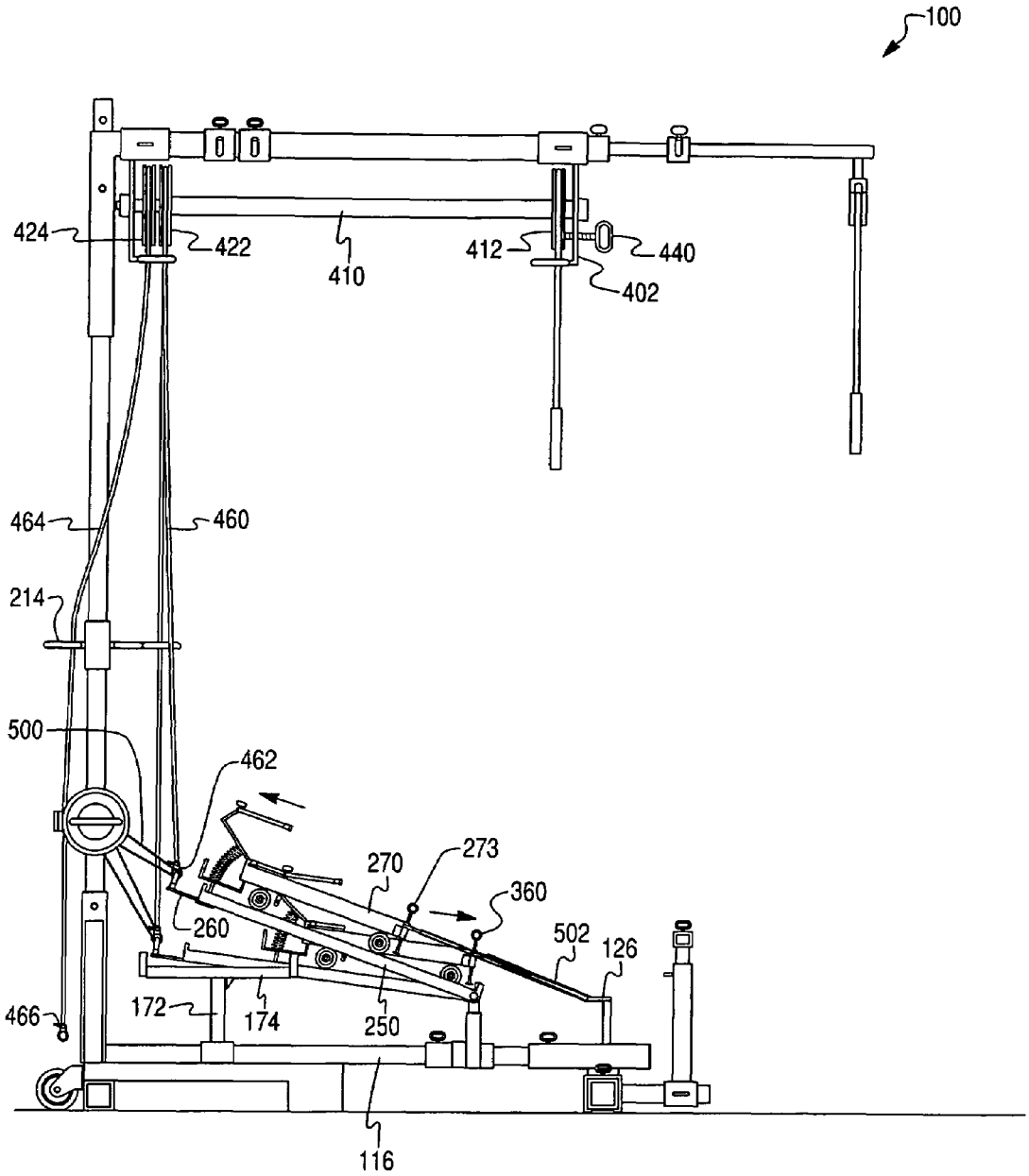
FIG. 8 is a side view of the exercise apparatus of FIG. 1, arranged to permit elliptical foot movements.

Set-up of exercise apparatus 100 for elliptical foot movement is performed as described above in regards to the pedal pivoting movement, with the following exceptions shown in FIG. 8. First, brakes 360 are deactivated to permit sliding movement of shoes 270 along runner channels 258. Second, resistance elements 502 are optionally applied by mounting one end of element 502 on hook 126 and the other end of element 502 on hook 273. Again, the number of resistance elements applied to hooks 273 of the left and right shoes may differ from one another, as may be desirable, for example, for an exerciser having one healthy leg and one injured leg, or an exerciser having disproportionate severities of injuries to his left and right legs.

In operation, seated user places his or her feet on respective foot plates 272. Preferably, the user's feet are positioned against distal face of heel buttresses 274. The user's foreleg extension and flexion movements slides shoes 270 reciprocally back and forth along pedals 250 while the user's concurrent hip extensor and flexor movements simultaneously pivot pedals about pivot shaft 246 to generate a substantially elliptical motion for simulating recumbent bicycling. Preferably, movement is accomplished without separating the user's feet from the respective foot plates 272. This exercise is useful in working all of the lower extremity muscles specified above as impacted by the pivoting and translational sliding movements. Grip 480 may be used to assist the up/down pivotal motion of pedals 250 (or the translational sliding motion of shoes 270), as described above.

Plantar Flexion

Pedals 250 are immobilized, for example, by resting pedals 250 on T-bar 174 or by activating turn key 440 with cable 460 clasped to eyelets 264. Shoes 270 also are immobilized against translational sliding movement, e.g., by tightening brakes 360. Preferably, pedals 250 are at an equal pitch to one another, and shoes 270 are in side-by-side relationship. The seated user rests his or her feet on foot plates 272 so that the user's toes are positioned on angled toe pad 290. The user plantar flexes his or her feet downward against resistance of upward-urging biasing member 358. When the user cannot depress toe pad 290 further, the upward urging force of biasing member 358 is allowed to return toe pad 290 to its start position, and the exercise is repeated. This exercise strengthens the posterior calf muscles, e.g., the gastrocnemius and soleus. The plantar flexion exercise of apparatus 100 is particularly suited for individuals having general foot weakness.

Dorsi Flexion

Pedals 250 and shoes 270 are immobilized, for example, by placing T-bar 174 under pedals 250 and activating brakes 360. Articulated double-arm bracket 304 is rotated downward towards the user's foot and retained in place using screw fastener 306. One or more resistance elements 504 extend between opposite arms of double-arm bracket 304, immediately above user's foot. The user dorsi flexes his or her feet upward against the resistance elements 504 to full range of motion, preferably separating the balls of his or her feet from toe pad 290 while retaining the heels of his or her feet on bottom plate 272. The user then relaxes his or her feet, returning them to start position for additional repetitions. The upward flexing of user's feet against resistance elements 504 strengthens the anterior calf muscles, e.g., the tibialis anterior. The dorsi flexion exercise described herein is particularly suited for individuals having twisted ankles or "foot drop," or that encounter frequent clumsiness or tripping.

Foot Everters and Inverters

Pedals 250 and shoes 270 are immobilized, for example, as discussed above with respect to plantar flexing movement. Resistance is furnished via one or more resistance elements 506 extending between upper arms 282 of side foot panels 278, one or more resistance elements 508 extending between lower arms 284 of side foot panels 278, or a combination thereof.

The everter exercise involves pivoting the foot outward about one's heel to displace outer side foot panel 280 outward about pivot joint 276, preferably pivoting the user's foot about the heel of the foot. This exercise makes use of the peroneus longus and peroneus brevis. Upon completing full range of motion, the foot is moved inward to its start position, and the exercise is repeated. The inverter exercise involves pivoting the foot inward about the heel to displace inner side foot panel 278 about pivot joint 276, making use of and strengthening the tibialis posterior. Again, upon completing full range of motion, the foot is moved to its start position, and the exercise is repeated. Everter and inverter exercises may be performed as alternating repetitions or alternating multi-repetition sets.

Shoulder Stretch

From the seated position, the user's hands grasp handles 490 of grip 486. Boom extender 228 may be adjusted forward or rearward to best accommodate the seated user, and locked in place via pin 232. While maintaining one arm or both arms straight at the elbow(s), the user slides grip strap 488 back and forth across pulley 492 for stretching shoulders (e.g., deltoids), chest (e.g., pectoralis major), and arms.

The wide variety of exercises capable of being performed using apparatus 100 allows for flexible and varied work-out routines, which may include, for example, single or multiple sets of at least one repetition of selected exercises.

Methods for assembling and disassembling exercise apparatus 100 should be evident from the above description. The various frame components may be made of steel or other metals or materials having sufficient strength and durability for their intended use.

A non-limiting embodiment for assembling exercise apparatus 100 will now be described. For the purpose of this description, all integral connections (as described above for the illustrated embodiment) are assumed complete prior to assembly. The lower support base of frame structure 110 is initially assembled. Collar adapter 176 with associated components (172, 174, 182) followed by central collar adapter with associated components (160, 162, 166) are successively received over proximal end of longitudinal frame member 116 and slid into desired locations. Next, collar 120 with associated components (112, 118, 122, 124) is received over proximal end of longitudinal frame member 116 and secured with fastener 122. Stabilizer bars 150 and their associated adjustment components (128, 132, 134, 136, 138, 140, 142, 144, 148, 152) are preferably pre-assembled on proximal frame member 112.

Stanchion 200 is assembled as follows. Mast 204 is lowered into mount base 202 and secured with locking pin 206. Collar adapter 452 with associated components (450, 454, 456, 458) followed by adapter 216 with associated components (212, 214) are successively received over top of mast 204 and lowered into place and secured. Next, mounting sleeve 222 with integral cantilever boom 224 and associated components (228, 230, 232, 402, 404) is received over top of mast 204, lowered into desired position, and secured with locking pin 226. Pulley assembly (e.g., 406, 410, 412, 422, 424, 460, 462, 464, 466) is then suspended from boom 224 by mounting shaft 406 on brackets 402 and 404. Cable 464 is fed through grooves of pulleys 454 by temporarily disengaging end clamps 458 to displace stays 456 away from the grooves.

Assembly of foot assemblies 240 will now be described. Referring to FIGS. 3 and 4, pivot shafts of inner side foot panel 278 and outer side foot panel 280 are placed in corresponding pivot joints 276 of heel buttress 274 and secured with nuts or other fasteners. Resistance elements 506 and 508 are preferably applied to upper arms 282 and lower arms 284, respectively. Shoe 270 is then placed on pedal 250. Proximal runner bolt 312 of runner assembly 310 is passed through a through hole of foot plate 272 and fed through a wheel mount supporting wheels 320. A spacer, washer, nut, etc. may be placed about wheel mount, if desired. Proximal runner bolt 312 is then passed through channel 258. Below pedal 250, a friction reduction pad 318 and washer 316 are mated with bolt 312 and secured thereto with nut 314 to complete proximal runner assembly 310. Distal runner assembly 330 may be established in similar manner.

Angled toe pad 290 is positioned between and generally forward of side foot panels 278 and 280. Spurs (not shown) projecting from the bottom of angled toe pad 290 are inserted through corresponding apertures of foot plate 272. The head of runner bolt 350 is mounted to angled toe pad 290 to extend downward and capture biasing member 358, which is seated on bracket 286. Runner bolt 350 is passed through a slot in bracket 286 and through runner channel 258. Friction reduction pad 368, washer 354, and nut 352 are mated with the bottom of runner bolt 350.

Foot assemblies 240 are then mounted on pivot shaft 246 (FIG. 5), and secured with locking pins 256 (FIG. 3). Prongs 244 of base support 242 are then lowered into seat 160 or 162. Depending upon the exercise to be performed, either clasps 462 of cable 460 are attached to eyelets 264 or clasps 466 of cable 464 are attached to eyelets 288. Resistance elements 500, 502, 504, 506 and/or 508 may then be applied as described above.

Figure 9:
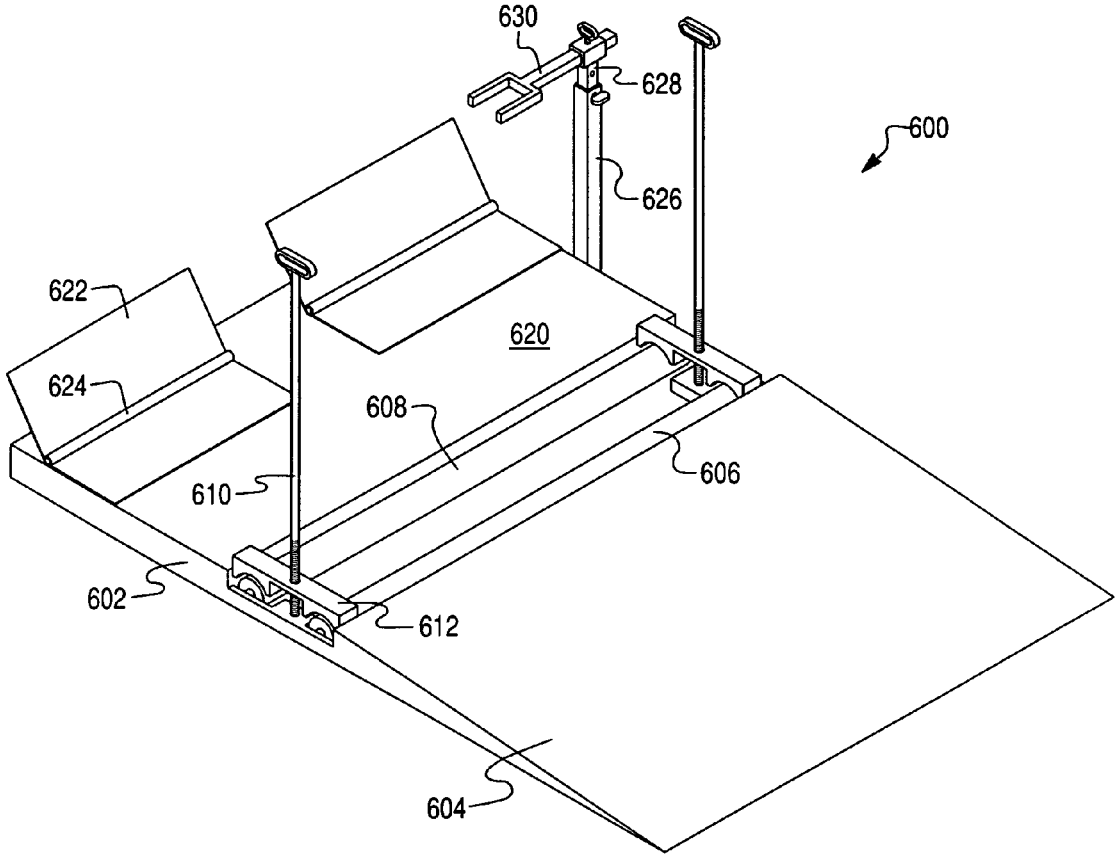
FIG. 9 is a perspective view of an embodiment of an assembly capable of being incorporated into the embodied exercise apparatus.
Figure 10:
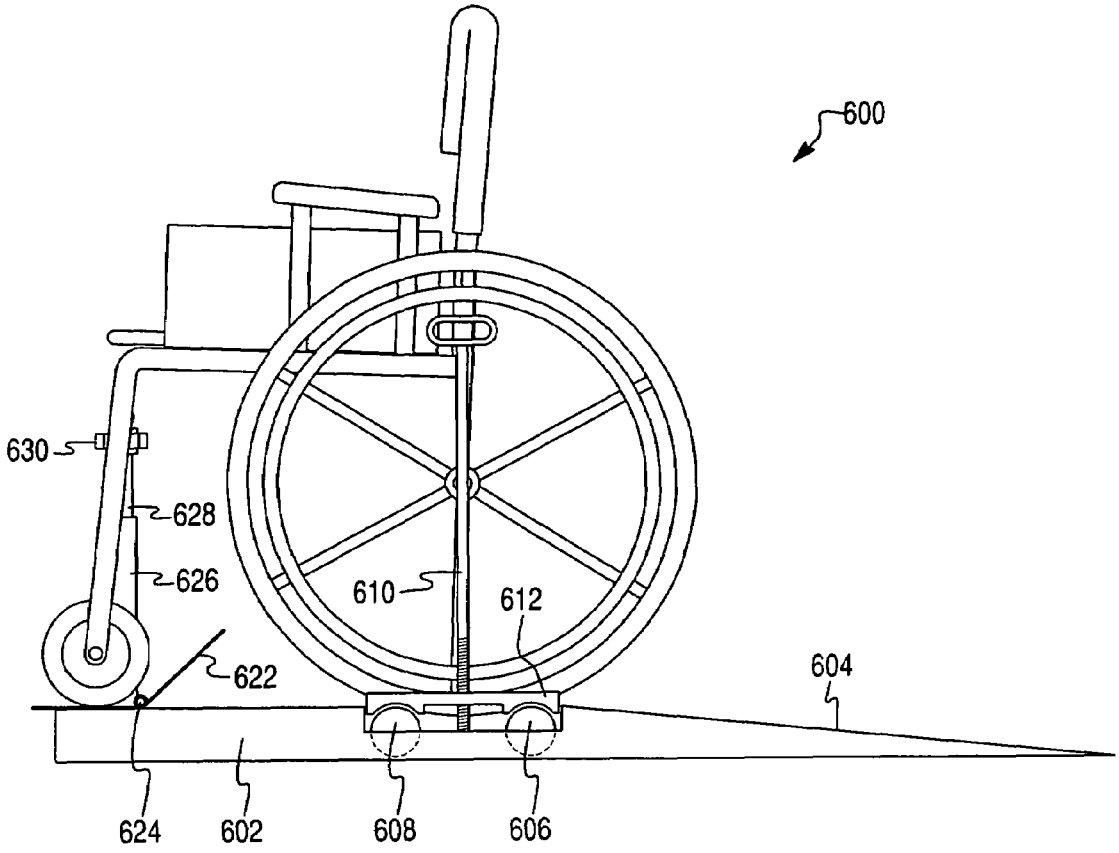
FIG. 10 is a side view of the assembly of FIG. 9.

FIGS. 9 and 10 illustrate an embodiment of an assembly 600 capable of incorporation into and use with the embodied exercise apparatus 100. Assembly 600 includes a platform 602 having a flat bottom surface resting on the ground. Platform 602 features a gradual ramp 604 having an end substantially level with the ground. Forward of ramp 604, platform 602 includes a recessed portion containing elongated cylindrical rollers 606 and 608. Rollers 606, 608 preferably are of equal length and diameter, and are arranged horizontally and parallel to one another. Spacing between rollers 606, 608 is sufficient to permit the rear (or drive) wheels of a wheelchair to come into contact with the upward facing surface portions of each of rollers 606, 608 so that rollers 606, 608 collectively cradle the wheelchair drive wheels. Rollers 606, 608 extend substantially the entire width of platform 602. The opposite ends of rollers 606, 608 rotatably engaged with side walls of the recessed portion, and are suspended in spaced relation with a bottom surface of the platform 602 and ground to promote free rotational motion of rollers 606, 608. The recess is sufficient in depth so that tops of rollers 606, 608 do not project substantially above the top surface of platform 602.

Assembly 600 further includes resistance adjuster 610 extending upward from a bore in platform 602. Resistance adjuster 610 includes a threaded stem portion engaging a threaded hole of resistance generator (or brake) 612. The ends of resistance generator 612 are positioned adjacent recess-defining walls of platform 602. Resistance adjuster 610 is turnable in opposite directions to move resistance generator 612 either upward in spaced relation to upward facing surfaces of rollers 606, 608 or downward into frictional contact with upward facing surfaces of roller 606, 608.

Forward of rollers 606, 608 is a level platform area 620 on which toggles 622 are pivotally mounted about pivot joints 624. A support post 626 is provided on one side of level platform area 620. Adjustable post extender 628 is telescopically received in support post 626, and slidably receives stabilizer bar 630. Preferably, stabilizer bar 630 has a two-prong end for engaging and securing a wheelchair against rearward, upward, and lateral movement. Although not shown, the stabilizer mechanisms (626-630) may be provided on both sides of level platform area 620 for engaging opposite sides of the wheelchair.

Assembly 600 is capable of being incorporated into the above embodied exercise apparatus 100 as follows. Stabilizer assemblies (i.e., 128-152) are removed from exercise apparatus 100, and the ledged end of platform 602 is placed in abutting relationship with lateral proximal frame member 112 so that distal end of collar 120 sits on level platform area 620 between toggles 622. Alternatively, lateral proximal frame member 112 and its associated components (120-126) may be removed from exercise apparatus 100, and the proximal end of longitudinal frame member 116 is rested on level platform area 620 between toggles 622.

In operation, the seated user moves his or her wheelchair from the floor surface forwardly onto and upwardly along ramp 604. Forward progression of the wheelchair is continued until the rear (or drive) wheels of the wheelchair are cradled between rollers 606, 608. Simultaneously, the forward (or castor) wheels of the wheelchair will travel over toggles 622, causing toggles 622 to pivot about pivot joints 624 into the position shown in FIG. 10. Pivotal movement of toggles 622 serves as an indicator or signal that the wheelchair has been properly positioned. Further, toggles 622 arranged as shown in FIG. 10 provide resistance against accidental backward movement of wheelchair during excise performance.

From the position depicted in FIG. 10, the user is able to perform all of the exercises described above, as well as the following additional exercise. With the wheelchair locked firmly in place using stabilizer bar 630, the wheelchair occupant can simulate wheelchair movement by propelling the drive wheels of the wheelchair forward while the wheelchair is retained in stationary position. This exercise is designed to strengthen upper body muscles, and in particular muscles in the shoulders, arms, and hands, as well as secondary effects on abdominal muscles. Because the wheelchair remains stationary, the exercise may be performed in a confined area. The difficulty of this exercise may be increased by turning resistance adjuster 610 to place resistance generator 612 in contact with rollers 606, 608, thereby selectively increasing resistance. When the user has completed the exercise routine, the stabilizer bar 630 is disengaged, and the user rolls the wheelchair backwards down ramp 604. During wheelchair rearward movement, the front wheels of the wheelchair pivot toggles 622 back to their original positions depicted in FIG. 9.

Figure 13:
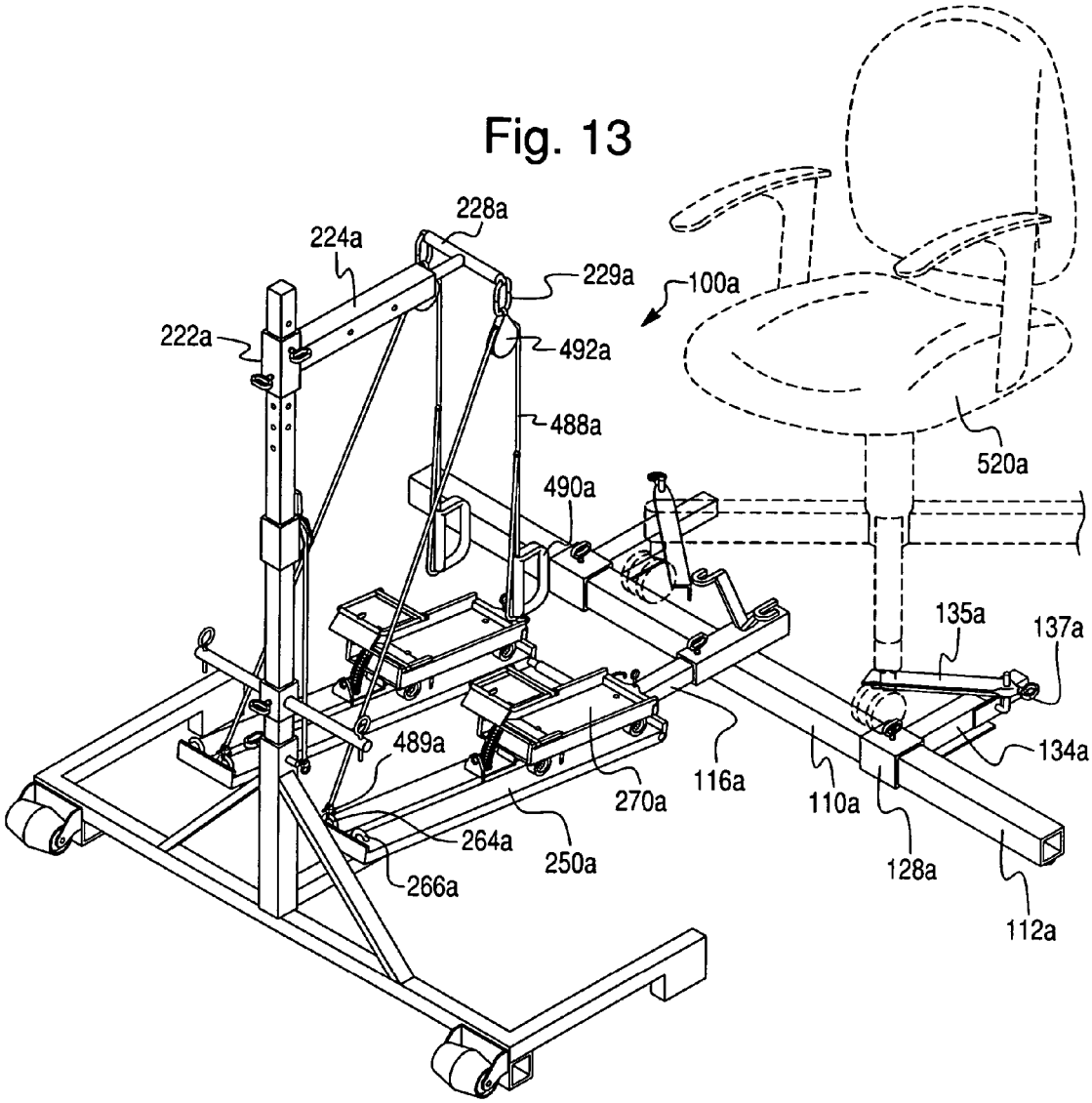
FIG. 13 is a perspective view of another embodiment of the exercise apparatus which is especially adapted for performance of upper body exercises.
Figure 14:
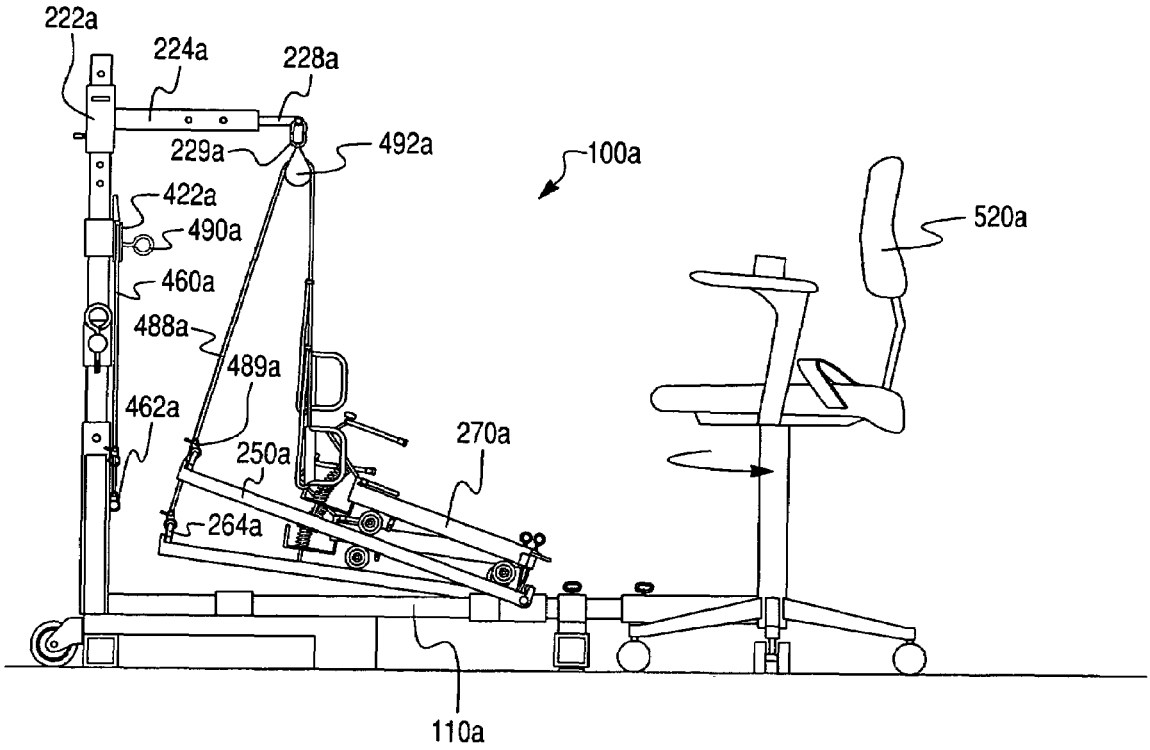
FIG. 14 is a side view of the apparatus of FIG. 13, with the addition of a swiveling seat member.

Another embodiment of the invention especially suited for performing upper body exercises for the torso and upper extremities is shown in FIGS. 13 and 14. It is contemplated and should be understood that exercise apparatus 700 may be modified to include features and modifications described above with regard to the other embodiments of the invention, but excluded from FIGS. 13 and 14 and the following description in the interests of brevity and simplification.

FIGS. 13-18 illustrate an exercise apparatus 100*a* used in conjunction with a swiveling chair 520*a*. Various connection mechanisms may be used for joining chair 520*a* to support frame structure 110*a*. FIGS. 14-18 show chair 520 equipped with an adapter member, similar to member 522 described above, capable of receiving and mating with longitudinal frame member 116*a*. An alternative mechanism is shown in FIG. 13, in which support frame structure 110*a* is provided with frame collar adapters 128*a* slidably received on proximal lateral frame member 112*a*. Proximal legs 134*a* extend from adapters 128*a*, and pivotally support guards 135*a*. In preparation of use of apparatus 100*a*, guards 135 are flared outwardly so as to permit chair 520*a* to be rolled forward until the front wheels or castors of chair 520*a* abut against proximal lateral frame member 112*a*. Guards 135 are then pivoted inward to rest immediately behind and preferably in contact with the front wheels or castors, as shown in FIG. 13. Fastener 137*a* is tightened to retain guards 135 in position, thereby locking chair 520*a* in and preventing it from rolling on the floor during exercise performance.

It should be understood that chair 520*a* may be replaced with alternative seating means as described above, or eliminated to permit wheelchair access, in which case a lateral support system, such as 128-152 shown in FIG. 1, or a platform assembly, such 600 shown in FIGS. 9 and 10, as well as other stabilizing components may be provided. Exercise apparatus 100*a* may also contain other features discussed above with regard to apparatus 100, both illustrated and not illustrated, such as resistance elements, heart rate and blood pressure monitors, alarms, etc.

Support frame structure 110*a* features a modified mounting sleeve 222*a* and an integrally connected, overhead modified cantilever boom 224*a*. Projecting from a proximal end of boom 224*a* is a T-bar 228*a*, which optionally may be telescopically received in slidable forward and rearward with respect to boom 224*a*. Links 229*a* suspend pulleys 492*a*. Pulley lines 488*a* are operatively connected to and received in grooves of pulleys 492*a*. Handles 490*a* provided at first ends of pulley lines 488*a*, and clasps 489*a* are provided at the opposite second ends of pulley lines 488*a*. Pulley lines 488*a* are sufficient in length to permit a seated user to reach and grasp handles 490*a* with opposite hands. When not in use, pulley lines 488*a* are stowed, for example, by placing handles 490*a* on a storage hook (not shown in FIG. 13). Examples of alternatives for handles 490*a* include straps, grips, bindings, Velcro, and the like. Pulley lines 488*a* may be replaced with, for example, ropes, cables, wire, flat belts, etc., and combinations thereof.

The foot assemblies preferably yet optionally are identical or similar to foot assemblies 240 discussed above. Like the foot assemblies described above with respect to apparatus 100, exercise apparatus 100*a* preferably yet optionally includes pedals 250*a* and shoes 270*a* identical or similar to those discussed above to permit the user to perform any or all of the exercises described above, including but not limited to the pedal pivoting exercise, the shoe translational sliding exercise, and the elliptical exercise. Pedals 250*a* include eyelets 264*a* at their distal ends. Clasps 489*a* selectively attach and detach the opposite ends of pulley line 488*a* to eyelets 264*a* of pedals 250*a*.

Apparatus 100*a* further includes pulley 422*a* and a pulley line 460*a*, such as a cable or the like, operatively connected to and received in a grooved slot of pulley 422*a*. Clasps 462*a* are provided at the opposite ends of pulley line 460*a*. For exercise movements involving pulley line 460*a*, clasps 462*a* are attached to eyelets 264*a* of pedals 250*a*. Clasps 462*a* are detached from eyelets 264*a* for exercise movements not requiring the use of pulley line 460*a*. Generally, pulley line 460*a* is employed for certain lower body exercises such as the pedal pivoting exercise and the elliptical exercise. Although not shown in FIGS. 13 and 14, it should be understood that pulley 422*a*, or an additional pulley mounted on support frame structure 110*a*, such as coaxially with pulley 422*a*, may be utilized together with another pulley line and a pulley assembly similar to 454 above to permit reciprocal shoe translational sliding movements.

A key 440*a* comprises a threaded stem is rotatable in opposite directions to move the end of key 440*a* either forward into abutting relationship with pulley 422*a* or rearward into spaced relationship with pulley 422*a*. In this manner, key 440*a* permits the user to lock pulley 422*a* and pulley line 460*a* stationary and prevents pivotal movement of pedals 250*a*. Hence, key 440*a* may be used to lock pedals 250*a* and a selected incline, such as if the seated user desires to perform the shoe translational sliding movements on stationary pedals 250*a*.

Various upper body exercises and movements that may be carried out with exercise apparatus 100*a* will now be discussed in detail.

Seated Cable Rowing Exercise

Figure 15:
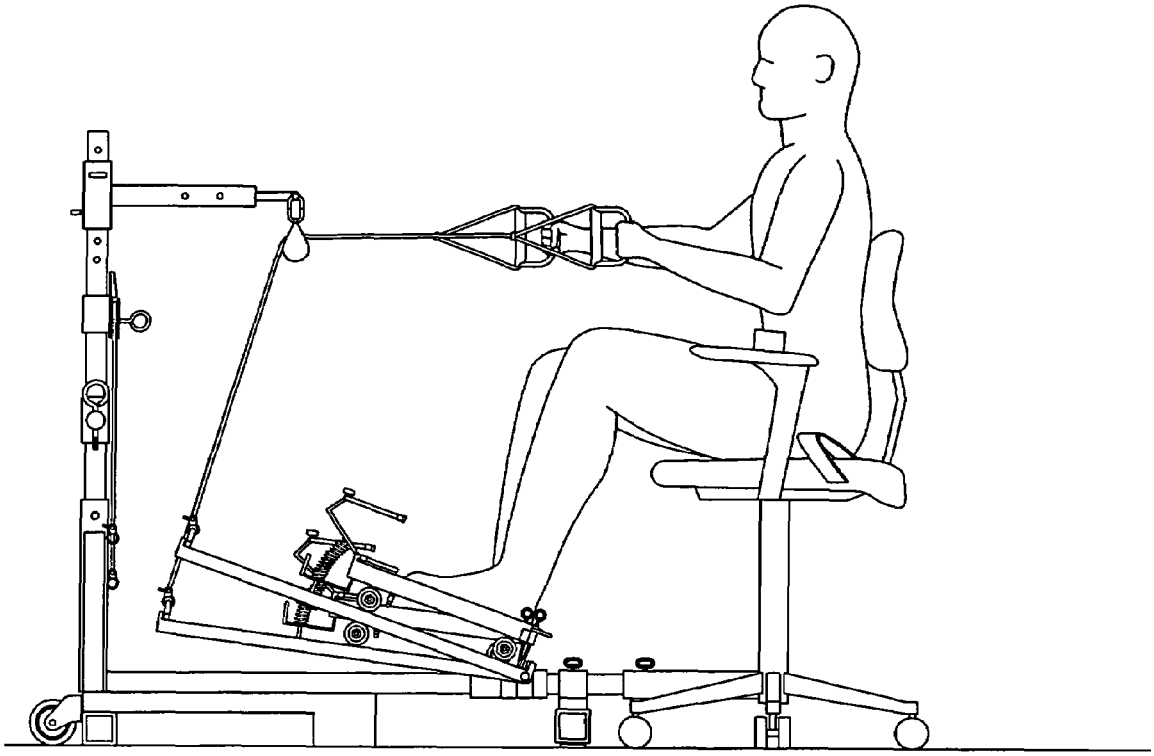
FIG. 15 is a side view of the apparatus of FIGS. 13 and 14, depicting a seated user performing seated cable rowing movements.

The user is seated in chair 520*a*, which may be replaced with another sitting device or removed to permit wheelchair access. As shown in FIG. 15, in preparation for the seated cable rows, exercise clasps 462*a* are detached from eyelets 264*a* and clasps 489*a* are attached to eyelets 264*a*. The seated user optionally places his or her feet on respective foot pedals 250*a*, and grasps handles 490*a* in his or her opposite hands with palms facing toward one another. From a seated, upright starting position with arms extended all the way forward to feel a stretch in the latissimus dorsi, the user pulls handles 490*a* straight back until the user's back is fully contracted. Handles 490*a* are then returned to the starting position slowly to complete a repetition. The rowing motion may be applied to both of handles 490*a* simultaneously or alternating manner. The foot assemblies function as weights, providing resistance to the rowing movement as pedals 250*a* pivot about their proximal ends. Seated cable rows are generally believed to primarily exercise the latissimus dorsi and trapezius muscles, and as "secondary muscles" the erector spinae, rear deltoids, biceps, biceps brachialis, and forearm flexors.

Seated Cable Chest Pressing Exercise

Figure 16:
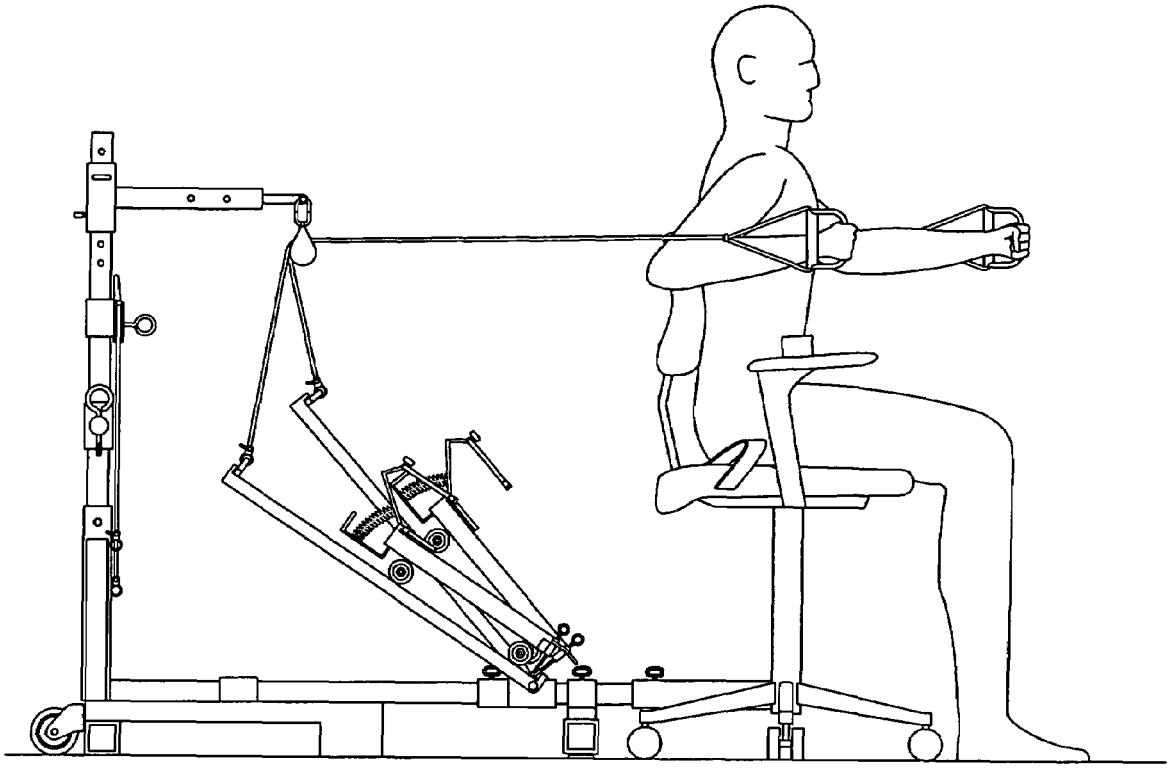
FIG. 16 is a side view of the apparatus of FIGS. 13 and 14, depicting a seated user performing chest pressing movements.

The user is able to transition between the seated cable rowing exercise and a chest pressing exercise by swiveling chair 520*a* 180 degrees to a position shown in FIG. 16. Handles 490*a* are grasped so that the palms of the user's hands face to the right in FIG. 16. The user then presses handles 490*a* straight forward away from his or her chest. Handles 490*a* may be pressed simultaneously or, as shown in FIG. 16, alternately. The foot assemblies provide resistance to the movement by pivoting about the proximal ends of pedals 250*a*. The primary muscles exercised using the seated cable chest press include the pectoralis major and the triceps brachii. The anterior deltoids, biceps, trapezius and other back muscles are worked as secondary muscles.

Seated Bicep Curl

Figure 17:
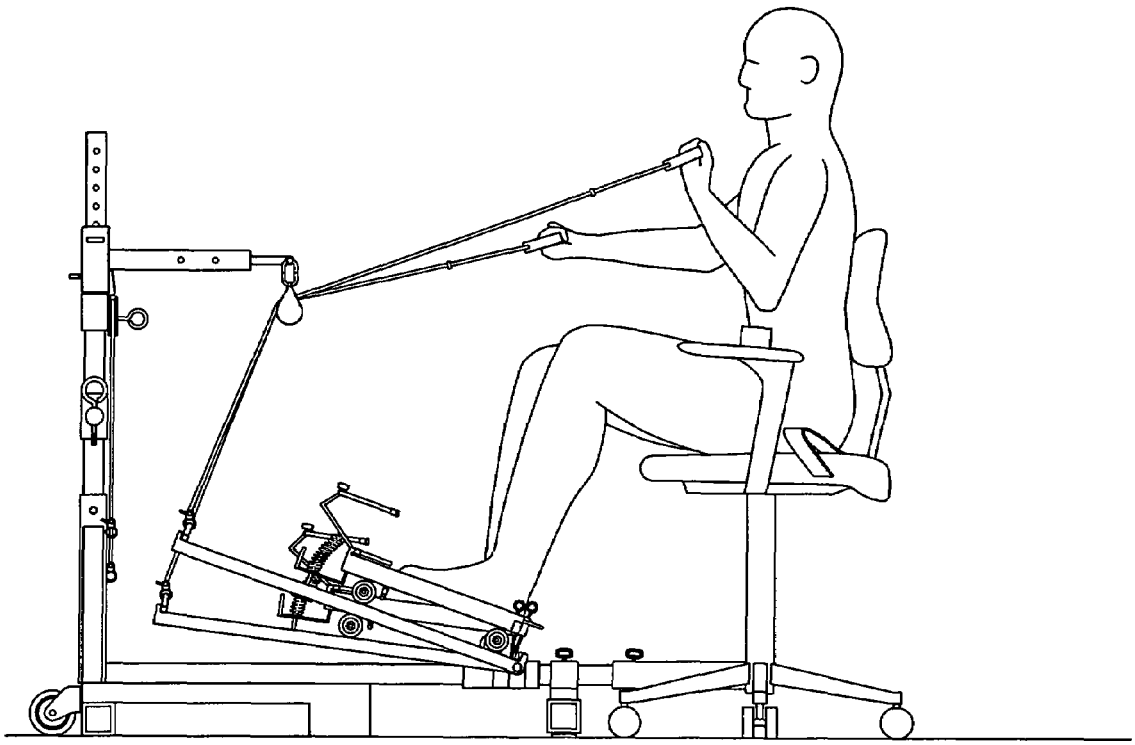
FIG. 17 is a side view of the apparatus of FIGS. 13 and 14, depicting a seated user performing bicep curling movements.

FIG. 17 shows the user seated in chair 520*a* with handles 490*a* grasped with his palms facing upward. With elbows at the side, handles 490*a* are raised upward and the forearm is rotated until the forearm is vertical and palms face the shoulders. Handles 490*a* are then lowered to their original position, preferably slowly, to complete the repetition. Variations are possible, such as performing a hammer curl motion in which palms remain facing inward. As with the exercises described above, handles 490*a* may be moved simultaneously or alternately. The primary muscle exercised is the bicep, while secondary muscles in the forearm are also affected.

Seated Tricep Extension

Figure 18:
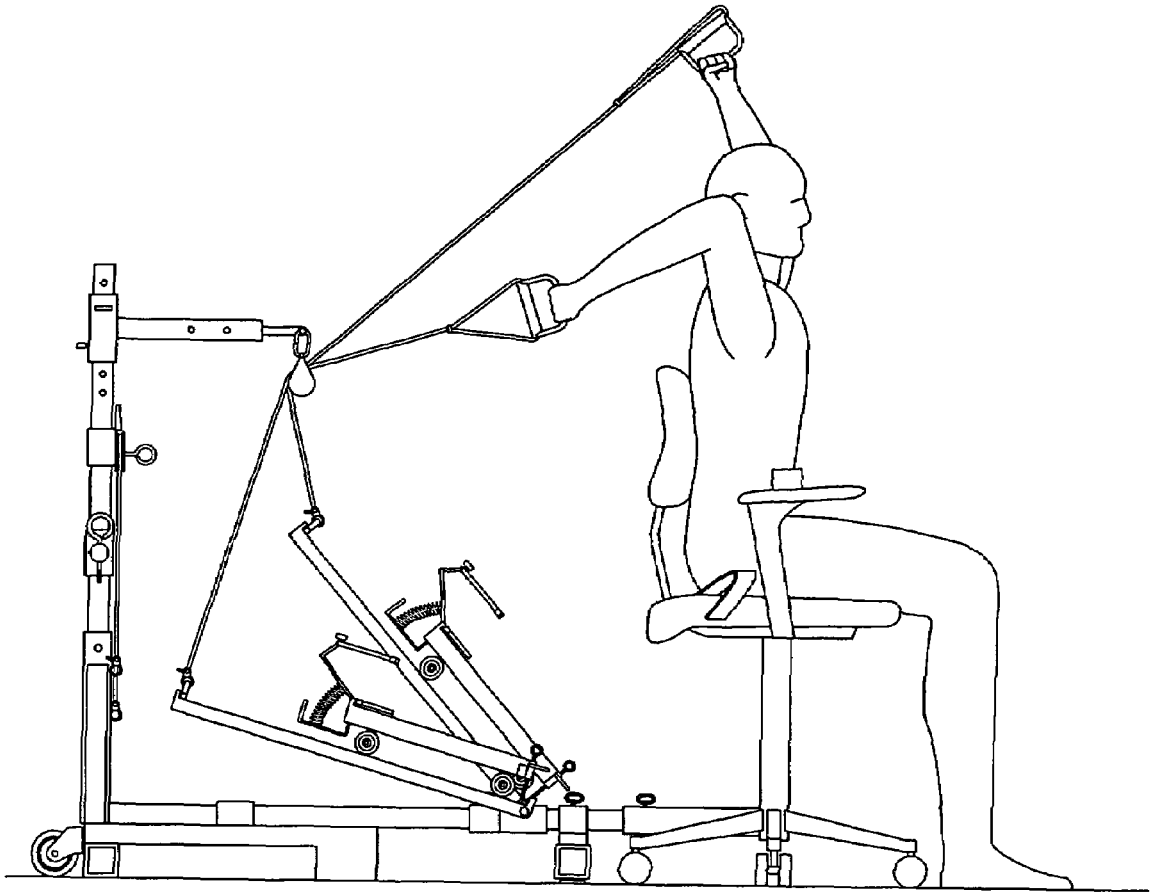
FIG. 18 is a side view of the apparatus of FIGS. 13 and 14, depicting a seated user performing tricep extension movements.

FIG. 18 shows the user seated in chair 520*a* facing away from apparatus 100*a*. The user is grasping handles 490*a* with palms facing inward. Although not shown, chair 520*a* may be slightly reclined during this exercise. Elbows are placed at the ears and arms are bent backwards at a 90 degree angle. Handles 490*a* are raised overhead into full extension, raising the forearms upwards as the elbows are retained near the ears. Handles 490*a* then are lowered to their original bent position to complete the repetition, which may be repeated multiple times. Variations of this exercise are possible, for example, with handles 490*a* moved in unison or in alternating fashion. The weight of the foot assemblies provides resistance to the movement.

The versatility of exercise apparatus 100*a* permits for other upper body workout movements not illustrated. For example, from a position shown in FIG. 16, the user may lean forward and press handles 290*a* overhead to simulate military presses, which impact the shoulder muscles. Lateral raises are another exercise that may be performed to impact the shoulder muscles, primarily the deltoids.

The above exercises have been described in connection with the use of separate handles 490*a* grasped by the opposite hands of the user. It should be understood that handles 490*a* may be replaced with alternative hand-graspable, cable-attachments. Further, pulley lines 488*a* may attach to a common hand-graspable component, such as a rope, straight-bar, "EZ-curl" bar, V-bar, a triangular double-handle row bar, double stirrup handles, etc.

In the above exercises, the foot assemblies apply a weighted resistance during the exercise movement as pedals 250*a* pivot about their proximal ends. Exercise apparatus 100*a* may be modified as described above to permit attachment of clasps 489*a* to shoes 270*a* instead of pedals 250*a*, so that shoes 270*a* slide longitudinally back and forth as the user performs the various upper body exercises. Resistance elements also may be used to supplement the resistance provided by the weight of pedals 250*a* and/or shoes 270*a*.

The foregoing detailed description of the certain preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. An exercise apparatus, comprising:

a support base;

first and second foot assemblies each configured to receive a respective foot of a seated user of the exercise apparatus, the first and second foot assemblies each comprising a respective proximal end portion and a respective distal end portion, the first and second foot assemblies mounted on the support base to permit selective performance and switching between a pivoting exercise and a translational sliding exercise, wherein the pivoting exercise comprises the seated user performing hip extension and flexion movements to motion the foot assemblies pivotally, and wherein the translational sliding exercise comprises the seated user performing foreleg extension and flexion movements by motioning the first and second foot assemblies longitudinally back and forth; and a pulley assembly comprising a pulley line operatively connected to at least one of the foot assemblies, and a hand-graspable component manipulable by the seated user for performing upper body exercise movements and causing the connected at least one foot assembly to provide resistance for the upper body exercise movements.

2. The exercise apparatus of claim 1, wherein:

the pulley assembly, pulley line, and hand-graspable component comprise a first pulley assembly, a first pulley line, and a first hand-graspable component, the first pulley line being operatively connected to the first foot assembly; and the exercise apparatus further comprises a second pulley assembly, the second pulley assembly comprising a second pulley line operatively connected to the second foot assembly, and a second hand-graspable component manipulable by the seated user for performing upper body exercise movements and causing the second foot assembly to provide resistance for the upper body exercise movements.

3. The exercise apparatus of claim 1, wherein the operative connection of the pulley line to the connected at least one foot assembly causes the upper body exercise movements of the seated user to motion the connected at least one foot assembly pivotally.

4. The exercise apparatus of claim 1, wherein the operative connection of the pulley line to the connected at least one foot assembly causes the upper body exercise movements of the seated user to motion the connected at least one foot assembly longitudinally back and forth.

5. The exercise apparatus of claim 1, wherein the foot assemblies are operatively mounted on the support base in such a manner as to permit selection of an elliptical exercise, the elliptical exercise comprising the seated user simultaneously performing the pivoting exercise and the translational sliding exercise to cause the feet of the seated user to follow substantially elliptical paths.

6. The exercise apparatus of claim 1, further comprising:

a first locking mechanism operatively associated with the first and second foot assemblies for selectively preventing the first and second foot assemblies from moving pivotally, while not interfering with sliding motion of the first and second foot assemblies associated with the translational sliding exercise; and a second locking mechanism operatively associated with the first and second foot assemblies for selectively preventing the first and second foot assemblies from sliding back and forth, while not interfering with pivoting motion of the first and second foot assemblies associated with the pivoting exercise.

7. The exercise apparatus of claim 1, wherein:

the pulley assembly, pulley line, and hand-graspable component comprise a first pulley assembly, a first pulley line, and a first hand-graspable component; and the exercise apparatus further comprises a second pulley assembly, the second pulley assembly comprising a second pulley line having opposite ends connected to the first and second foot assemblies, respectively, and a pulley mountable on the support base for causing the first and second foot assemblies to pivot reciprocally of one another.

8. The exercise apparatus of claim 1, wherein:

the first foot assembly comprises a first pedal pivotally connected to the support base, and a first shoe slidably carried on the first pedal;

the second foot assembly comprises a second pedal pivotally connected to the support base, and a second shoe slidably carried on the second pedal;

the first and second pedals are constructed and arranged to pivot during the pivoting exercise and selectively remain stationary during the translational sliding exercise; and the first and second shoes are constructed and arranged to selectively remain stationary relative to the first and second pedals, respectively, during the pivoting exercise and slide back and forth during the translational sliding exercise.

9. The exercise apparatus of claim 8, wherein the first and second shoes are constructed and arranged to slide back and forth along the first and second pedals while the first and second pedals simultaneously pivot to cause the first and second shoes to follow substantially elliptical paths.

10. The exercise apparatus of claim 1, wherein the upper body exercise movements comprise bicep extension and flexion curling movements, and further wherein the hand-graspable component is movable in the curling movements while the connected at least one foot assembly provides resistance.

11. The exercise apparatus of claim 1, wherein the upper body exercise movements comprise tricep extension movements, and further wherein the hand-graspable component is movable in the tricep extension movements while the connected at least one foot assembly provides resistance.

12. The exercise apparatus of claim 1, wherein the upper body exercise movements comprise, from the seated position and facing away from the foot assemblies, chest pressing movements, and further wherein the hand-graspable component is movable in the chest pressing movements while the connected at least one foot assembly provides resistance.

13. The exercise apparatus of claim 1, wherein the upper body exercise movements comprise latissimus dorsi rowing movements, and further wherein the hand-graspable component is movable in the rowing movements while the connected at least one foot assembly provides resistance.

14. A method of performing upper body exercises from a seated position, comprising:

providing the exercise apparatus of claim 1;

from a seated position, grasping the hand-graspable component; and performing upper body exercise movements and causing the connected at least one foot assembly to provide resistance to the upper body exercise movements.

15. An exercise apparatus, comprising:

a support base;

first and second pedals each configured to receive a respective foot of a seated user of the exercise apparatus for permitting the seated user to perform a lower extremity exercise; and a pulley assembly comprising a pulley line operatively connected to at least one of the pedals, and a hand-graspable component manipulable by the seated user for performing upper body exercise movements and causing the connected at least one pedals to provide resistance for the upper body exercise movements.

16. The exercise apparatus of claim 15, further comprising:

the pulley assembly, pulley line, and hand-graspable component comprise a first pulley assembly, a first pulley line, and a first hand-graspable component, the first pulley line being operatively connected to the first pedal; and a second pulley assembly comprising a second pulley line operatively connected to the second pedal, and a second hand-graspable component manipulable by the seated user for performing upper body exercise movements and causing the second pedal to provide resistance for the upper body exercise movements.

17. The exercise apparatus of claim 15, wherein:

the first and second pedals each comprise a respective proximal end portion and a respective distal end portion, the proximal end portions of the first and second pedals each pivotally connected to the support base for permitting the seated user to perform hip extension and flexion movements by reciprocally pivoting the distal end portions of the pedals between raised and lowered positions; and the hand-graspable component the upper body exercise movements causes the connected at least one pedal to provide resistance to the upper body exercise movements while the at least one pedal pivots between the raised and lowered positions.

18. The exercise apparatus of claim 15, wherein the pedals are operatively mounted on the support base in such a manner as to permit selection of an elliptical exercise in which the feet of the seated user follow substantially elliptical paths.

19. The exercise apparatus of claim 15, wherein:

the pulley assembly, pulley line, and hand-graspable component comprise a first pulley assembly, a first pulley line, and a first hand-graspable component; and the exercise apparatus further comprises a second pulley assembly comprising a second pulley line having opposite ends connected to the first and second pedals, respectively, and a pulley mountable on the support base for causing the first and second pedals to pivot reciprocally of one another.

20. The exercise apparatus of claim 15, wherein the upper body exercise movements comprise bicep extension and flexion curling movements, and further wherein the hand-graspable component is movable in the curling movements while the connected at least one pedal provides resistance.

21. The exercise apparatus of claim 15, wherein the upper body exercise movements comprise tricep extension movements, and further wherein the hand-graspable component is movable in the tricep extension movements while the connected at least one pedal provides resistance.

22. The exercise apparatus of claim 15, wherein the upper body exercise movements comprise, from the seated position and facing away from the pedals, chest pressing movements, and further wherein the hand-graspable component is movable in the chest pressing movements while the connected at least one pedal provides resistance.

23. The exercise apparatus of claim 15, wherein the upper body exercise movements comprise latissimus dorsi rowing movements, and further wherein the hand-graspable component is movable in the rowing movements while the connected at least one pedal provides resistance.

24. A method of performing upper body exercises from a seated position, comprising:

providing the exercise apparatus of claim 15;

from a seated position, grasping the hand-graspable component; and performing upper body exercise movements and causing the connected at least one pedal to provide resistance to the upper body exercise movements.

* * * * *